US005389486A

United States Patent [19]

Kiyoyanagi et al.

[11] Patent Number: 5,389,486

[45] Date of Patent: Feb. 14, 1995

[54] ELECTROPHOTOGRAPHIC TONER

[75] Inventors: Tadayuki Kiyoyanagi, Urawa; Junko Yoshioka, Yono; Shigeo Yamamura, Omiya; Masaharu Nomura, Hasuda, all of Japan

[73] Assignee: Nippon Kayaku Kabushiki Kaisha, Tokyo, Japan

[21] Appl. No.: 102,706

[22] Filed: Aug. 5, 1993

Related U.S. Application Data

[63] Continuation-in-part of Ser. No. 844,473, Mar. 2, 1992, abandoned.

[30] Foreign Application Priority Data

Mar. 5, 1991 [JP] Japan ..... 3-062499
Jan. 17, 1992 [JP] Japan ..... 4-025980

[51] Int. Cl.[6] ..... G03G 9/00
[52] U.S. Cl. ..... 430/110; 430/138
[58] Field of Search ..... 430/110, 138

[56] References Cited

U.S. PATENT DOCUMENTS 3,791,827 2/1974 Bush et al. .
4,837,394 6/1989 Alexandrovich et al. ..... 430/110
4,988,615 1/1991 Davies et al. ..... 430/576
5,061,589 10/1991 Shindoh et al. ..... 430/110
5,147,748 9/1992 Gitzel et al. ..... 430/110
5,225,305 7/1993 Kiyoyanagi et al. ..... 430/110

FOREIGN PATENT DOCUMENTS 0328391 8/1989 European Pat. Off. .
2238051 8/1972 Germany .
61-156142 3/1986 Japan .
61-213856 4/1986 Japan .
61-217064 11/1986 Japan .
218568 8/1990 Japan .

*Primary Examiner*—Marion E. McCamish
*Assistant Examiner*—Laura S. Weiner
*Attorney, Agent, or Firm*—Nields & Lemack

[57] ABSTRACT

An electrophotographic toner containing a specific compound as the charge control agent is described. The electrophotographic toner according to the present invention have a sharper distribution of the amount of electrification and better moisture resistance and time stability than those of a toner wherein a conventional charge control agent is used. Therefore it can provide an image having a very high gradation and has a very high capability of repeatedly forming an image. Since the charge control agent, as such, is essentially colorless, a colorant can freely be selected according to a hue required of a color toner and the toner is not detrimental to the hue inherent in a dye and a pigment.

11 Claims, No Drawings

ELECTROPHOTOGRAPHIC TONER

This application is a continuation-in-part of application Ser. No. 07/844,473, filed Mar. 2, 1992, now abandoned.

BACKGROUND OF THE INVENTION

The present invention relates to a toner used for developing an electrostatic latent image in an electrophotography, an electrostatic recording, etc.

An imaging process wherein use is made of static electricity, such as electrostatic recording or electrostatic photography, comprises the step of forming an electrostatic latent image and the step of visualizing the electrostatic latent image. The electrostatic latent image is formed by light signal on a photosensitive material prepared by coating a base material such as aluminum and paper with a photoconductive material such as phthalocyanine pigment, selenium, cadmium sulfide and amorphous silicon. The electrostatic latent image thus formed is visualized by subjecting colored fine particles called toner having a particle diameter regulated to 5 to 50 μm to contact electrification with a charge carrier such as iron powder and ferrite powder (two-component development) or direct electrification (one-component development) and then allowing the charged toner to act on the electrostatic latent image. It is necessary to impart a charge corresponding to the polarity of the electrostatic latent image formed on the photoconductive material, that is, either a positive charge or a negative charge, to the toner.

The colored fine particle called toner generally comprises a binder resin and a colorant as the indispensable components and an optional component such as a magnetic powder. An electric charge can be imparted to the toner through the utilization of an electrification property of the binder resin per se without using any charge control agent. In this method, however, no good image quality can be obtained due to poor time stability and poor moisture resistance. For this reason, a charge control agent is usually added for the purpose of retaining and controlling the electric charge.

Quality characteristics required of the toner include excellent electrifiability, fluidity and fixing property. These quality characteristics are greatly affected by the charge control agent used for the toner.

Examples of the conventional charge control agent added to the toner include (1) colored negative charge control agents such as 2:1 metallic complex salt dyes (Japanese Patent Publication (KOKOKU) Nos. 26478/1970 and 20153/1966) and phthalocyanine pigments (Japanese Patent Application Laid-Open (KOKAI) No. 45931/1977), and colorless negative charge control agents such as metal complexes of aromatic dicarboxylic acids (Japanese Patent Publication (KOKOKU) No. 7384/1984), metal complexes of salicylic acid (Japanese Patent Application Laid-Open (KOKAI) No. 104940/1982), or those described in Japanese Patent Application Laid-Open (KOKAI) No. 3149/1986; and (2) positive charge control agents such as nigrosine dyes, triphenylmethane dyes, various quaternary ammonium salts (Bulletin of the Institute of Electrostatics Japan, vol. 4, No. 3, P. 144 (1980)) and organotin compounds such as dibutyltin oxide (Japanese Patent Publication (KOKOKU) No. 29704/1982). The toners containing these compounds as the charge control agent, however, do not sufficiently satisfy the quality characteristics requirements for the toner, such as electrifiability and time stability.

For example, although the amount of electrification of the toner containing a 2:1 metallic complex salt dye known as the negative charge control agent is on a fair level, this dye is disadvantageously poor in the dispersibility in a binder resin on the whole.

For this reason, the dye is not homogeneously dispersed in the binder resin, and the distribution of the amount of charge extremely lacks in sharpness. The resultant image has a low gradation and is poor in the image forming capability. Further, the 2:1 metallic complex salt dye is disadvantageous because it cannot be used but for a toner having a shade of color limited to black or blackish hue. The use of this dye for a color toner is detrimental to the brightness of the colorant.

Examples of the nearly colorless negative charge control agent include a metal complex of an aromatic dicarboxylic acid (Japanese Patent Publication (KOKOKU) No. 7384/1984). This charge control agent, however, is disadvantageous in that it cannot become completely colorless and the dispersibility is poor. A metal complex of salicylic acid is a charge control agent having relatively good electrifiability (Japanese Patent Application Laid-Open (KOKAI) No. 104940/1982), but causes safety problems owing to its inclusion of a heavy metal. Examples of the colorless negative charge control agent containing no heavy metal include a compound disclosed in Japanese Patent Application Laid-Open (KOKAI) Nos. 3149/1986 and 38958/1988. These compounds, however, are disadvantageous in that it is difficult to produce toners having a good stability because the heat stability during the production of the toner is poor due to low melting points of the compounds and that the rise of the charge is slow.

The nigrosine dyes and triphenylmethane dyes known as positive charge control agents as well are colored and therefore can be used only for a toner having a color limited to black or blackish color. They are also poor in the time stability in continuous copying. The quaternary ammonium salt, when incorporated in a toner, has a poor time stability attributable to its insufficient moisture resistance and therefore cannot provide an image having a good quality in repeated use.

Thus, the conventional charge control agents do not sufficiently satisfy the quality characteristics requirements for the toner.

SUMMARY OF THE INVENTION

An object of the present invention is to provide a colorless positive charge control agent containing no heavy metal and having a good dispersibility in a binder resin, an excellency in the rise of the charge and its stability, no susceptibility to temperature change and humidity change and a high capability of controlling electrification. Another object is to provide a toner having excellent stability in the rise of the charge and environmental resistance and capable of providing an image having a high gradation.

The present inventors have made an intensive effort to solve the above-described problems and, as a result, have found that the incorporation of at least one compound represented by the following formula (1) in a toner remarkably improves the electrification characteristics. The present invention has accomplished based on this finding.

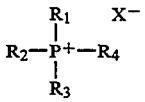

(1 wherein $R_1$, $R_2$ and $R_3$ independently represent an alkyl group having 4 to 8 carbon atoms, a cycloalkyl group, a substituted or unsubstituted aryl group, or a substituted or unsubstituted benzyl group; $R_4$ represents an alkenyl group, 3-phenyl-2-propenyl group, an alkynyl group, 3-phenyl-2-propynyl group, or a group represented by the formula:

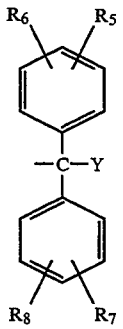

where $R_5$, $R_6$, $R_7$ and $R_8$ independently represent hydrogen atom, acetyl group, an alkyl group having 1 to 5 carbon atoms, methoxy group, ethoxy group, hydroxyl group, dimethylamino group, diethylamino group, or amino group, and Y represents hydrogen atom, an alkyl group having 1 to 8 carbon atoms, an aryl group having 6 to 8 carbon atoms, an aralkyl group having 7 to 10 carbon atoms, or a group of —CO—O—$R_9$ or —CO—NH—$R_9$ where $R_9$ represents a substituted or unsubstituted alkyl group, a substituted or unsubstituted aryl group, a substituted or unsubstituted aralkyl group, or a substituted or unsubstituted cycloalkyl group; and $X^-$ represents an anion.

The electrophotographic toner according to the present invention have a sharper distribution of the amount of electrification and better moisture resistance and time stability than those of a toner wherein a conventional charge control agent is used. Therefore it can provide an image having a very high gradation and has a very high capability of repeatedly forming an image. Since the charge control agent, as such, is essentially colorless, a colorant can freely be selected according to a hue required of a color toner and the toner is not detrimental to the hue inherent in a dye and a pigment.

DETAILED DESCRIPTION OF THE INVENTION

Among the compound represented by the formula (1), one preferred type is a compound represented by the following formula (2):

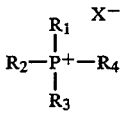

(2 wherein $R_1$, $R_2$ and $R_3$ independently represent an alkyl group having 4 to 8 carbon atoms, a cycloalkyl group, a substituted or unsubstituted aryl group, or a substituted or unsubstituted benzyl group; $R_4$ represents an alkenyl group, 3-phenyl-2-propenyl group, an alkynyl group, or 3-phenyl-2-propynyl group; and $X^-$ represents an anion.

The other preferred type of the compound represented by the formula (1) is a compound represented by the following formula (3):

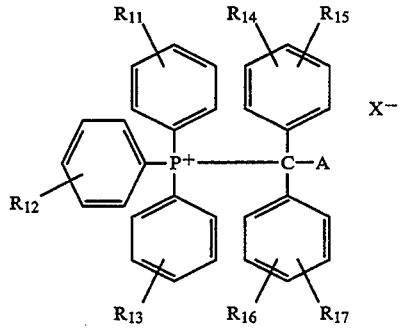

(3 wherein $R_{11}$, $R_{12}$ and $R_{13}$ independently represent a halogen atom, an alkyl group having 1 to 6 carbon atoms, methoxy group, or ethoxy group; $R_{14}$, $R_{15}$, $R_{16}$ and $R_{17}$ independently represent hydrogen atom, acetyl group, an alkyl group having 1 to 5 carbon atoms, methoxy group, ethoxy group, hydroxyl group, dimethylamino group, diethylamino group, or amino group; A represents hydrogen atom, an alkyl group having 1 to 8 carbon atoms, an aryl group having 6 to 8 carbon atoms, an aralkyl group having 7 to 10 carbon atoms, or a group of —CO—O—$R_{18}$ or —CO—NH—$R_{18}$ where $R_{18}$ represents a substituted or unsubstituted alkyl group, a substituted or unsubstituted aryl group, a substituted or unsubstituted aralkyl group, or a substituted or unsubstituted cycloalkyl group; and $X^-$ represents an anion.

The preferred further type of the compound of the formula (1) is a compound represented by the following formula (4):

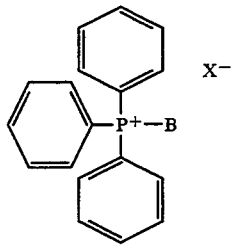

(4 wherein B represents an alkenyl group, 3-phenyl-2-propenyl group, an alkynyl group, or 3-phenyl-2-propynyl group, and $X^-$ represents an anion.

Another preferred type of the compound represented by the formula (1) is a compound represented by the following formula (5):

(5

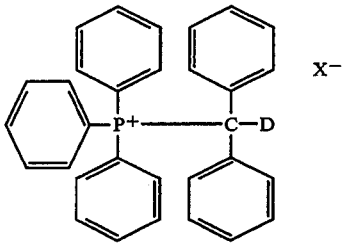

wherein D represents hydrogen atom, an alkyl group having 1 to 8 carbon atoms, an aryl group having 6 to 8 carbon atoms, an aralkyl group having 7 to 10 carbon atoms, or a group of —CO—O—$R_{19}$ or —CO—N-H—$R_{19}$ where. $R_{19}$ represents a substituted or unsubstituted alkyl group, a substituted or unsubstituted aryl group, a substituted or unsubstituted aralkyl group, or a substituted or unsubstituted cycloalkyl group, and $X^-$ represents an anion.

In the formula (1), preferred cycloalkyl group for the respective $R_1$, $R_2$ and $R_3$ is cyclohexyl group and preferred aryl group therefor may include 6 to 8 carbon atoms.

In the formula (1), preferred alkenyl group and alkynyl group for $R_4$ may include 3 to 6 carbon atoms.

In the formula (1), preferred group for $R_9$ may be a substituted or unsubstituted alkyl group having 1 to 12 carbon atoms, a substituted or unsubstituted cycloalkyl group having 3 to 6 carbon atoms, a substituted or unsubstituted aryl group having 6 to 8 carbon atoms, or a substituted or unsubstituted aralkyl group having 7 to 10 carbon atoms.

In the formula (1), preferred aryl group for Y may be selected from the group consisting of phenyl and naphthyl, and preferred aralkyl group may be selected from the group consisting of benzyl, α-methylbenzyl, diphenylmethyl and phenethyl.

In the above formulae, $X^-$ preferably represents an electrophotographically acceptable anion.

The compound represented by the formula (1) acts as a positive charge control agent. This compound has a good compatibility with a binder resin, and a toner containing this compound has a high specific electrification amount and a good time stability and therefore can stably provide a clear image in the image formation through electrostatic recording even after storage for a long period of time. Since the compound of the formula (1) is colorless, it is easy to prepare any colored toners and black toner starting with the compound. In addition, this compound does not contain any heavy metal which may cause safety problems in the environments.

Specific examples of the compound represented by the above formulae which may be incorporated as a charge control agent in a toner include those represented by the following formulae, though the compound of the formula (1) according to the present invention is not limited to these compounds only.

1

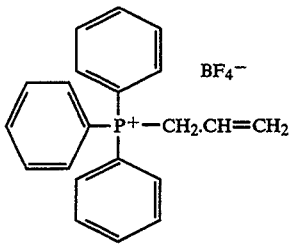

2

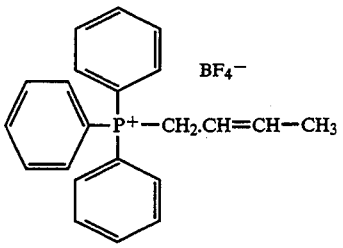

3

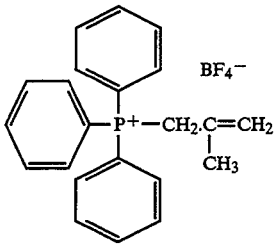

4

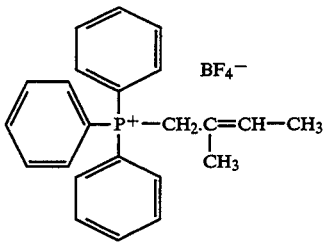

5

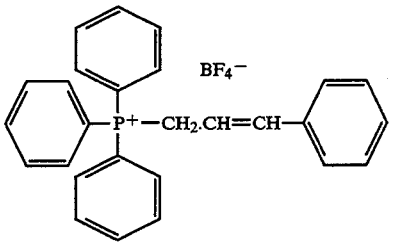

6

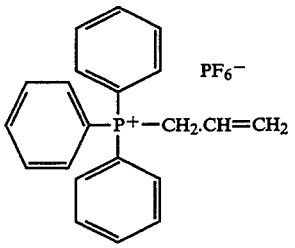

-continued
7
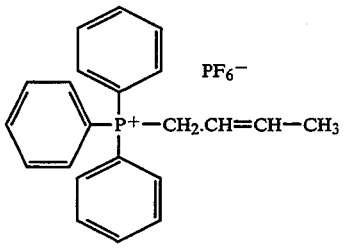
8
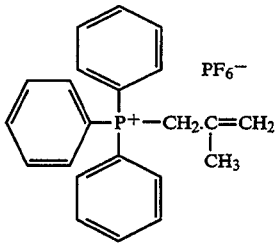
9
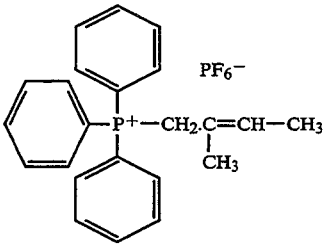
10
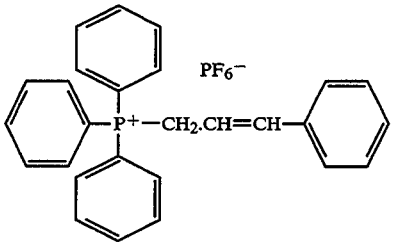
11
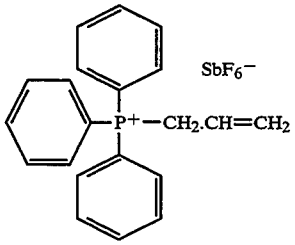
12
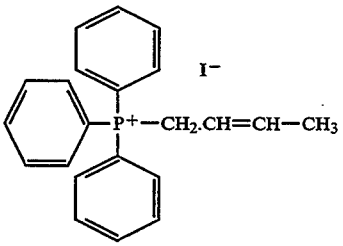
-continued
13
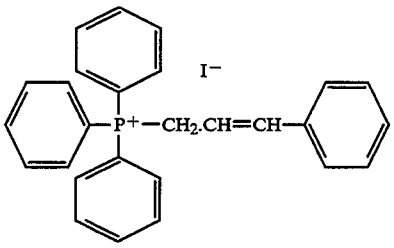
14
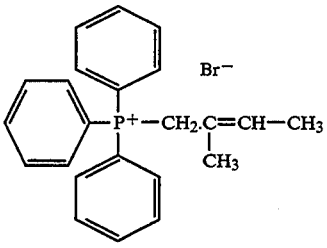
15
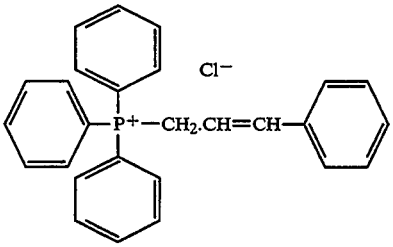
16
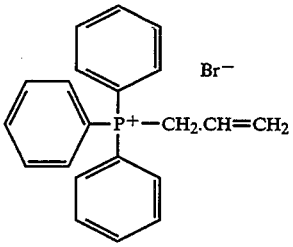
17
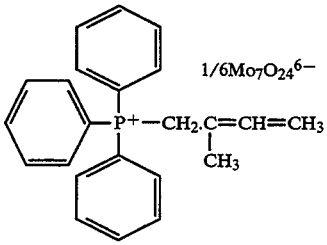
18
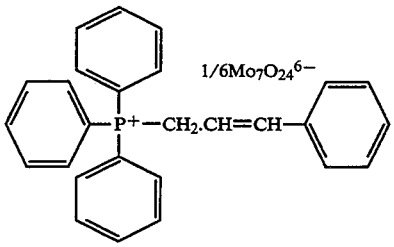

-continued
19
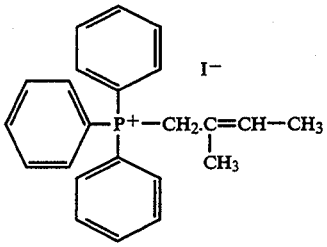
20
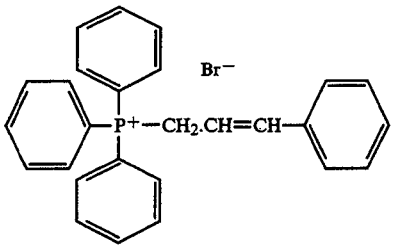
21
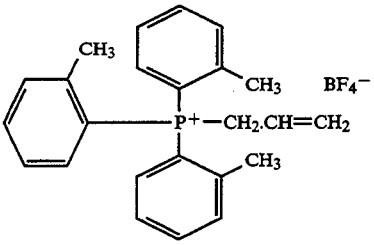
22
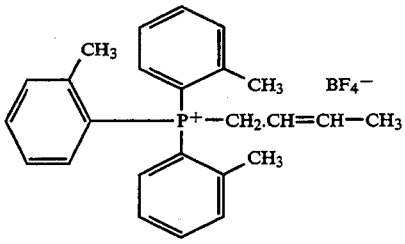
23
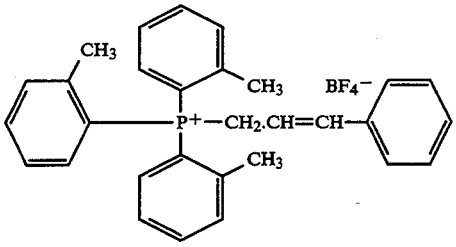
24
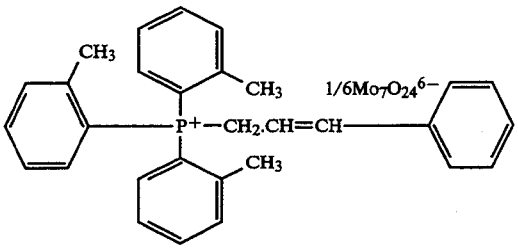
-continued
25
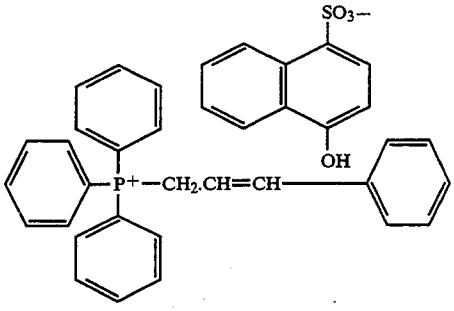
26
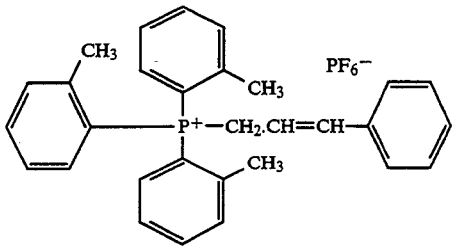
27
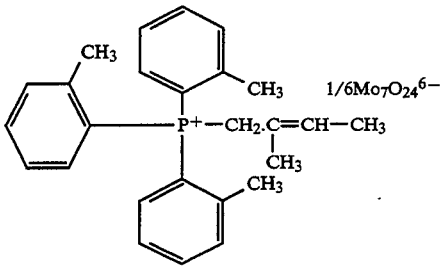
28
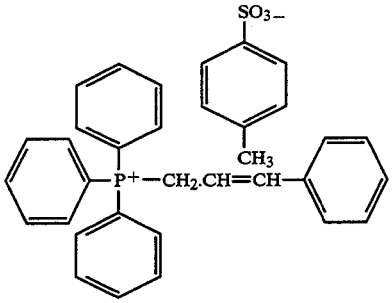
29
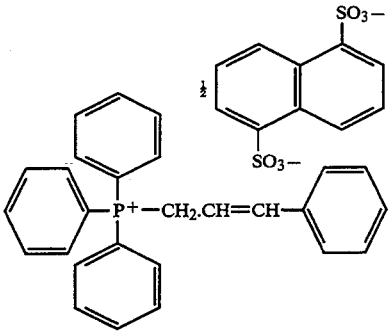

-continued
30
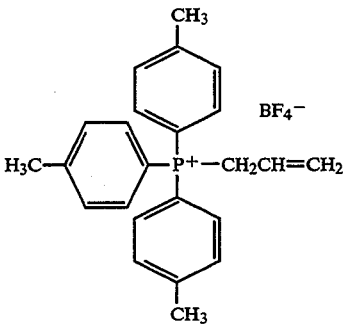
31
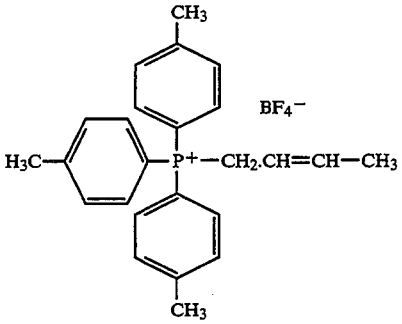
32
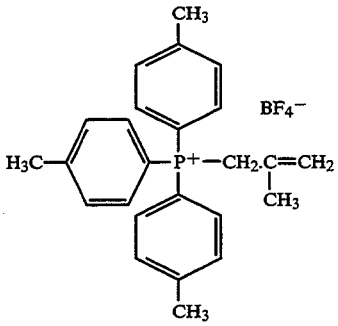
33
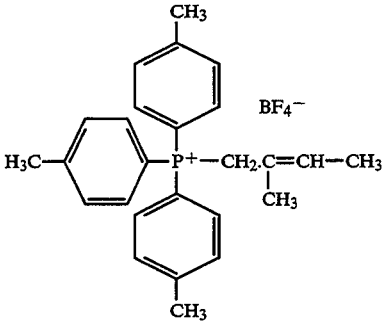
34
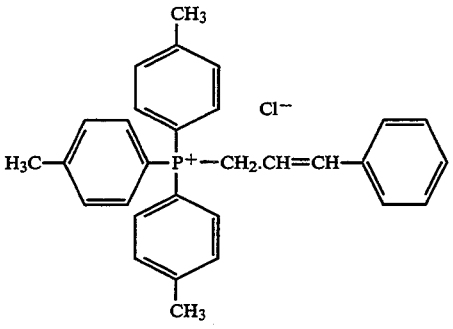
-continued
35
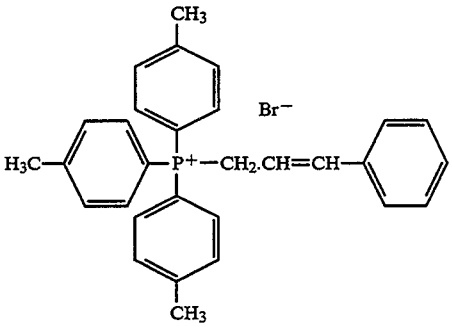
36
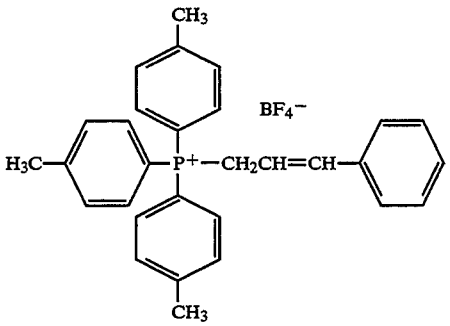
37
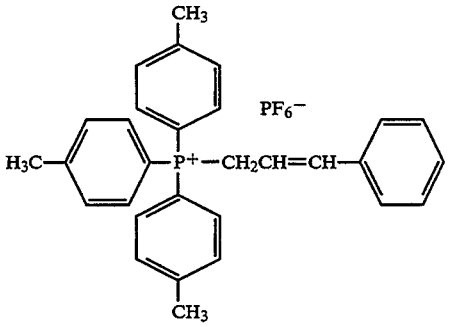
38
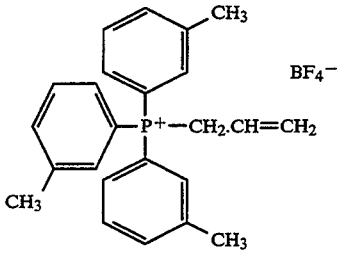
39
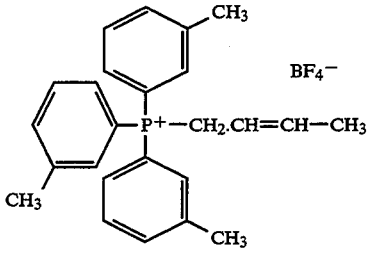

-continued
40
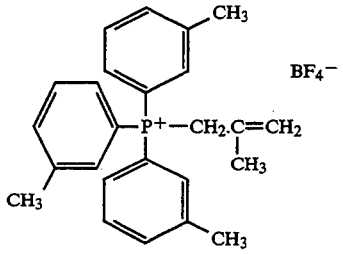
41
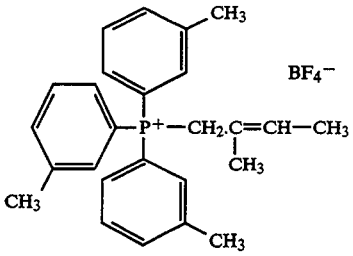
42
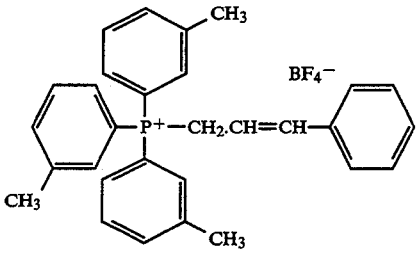
43
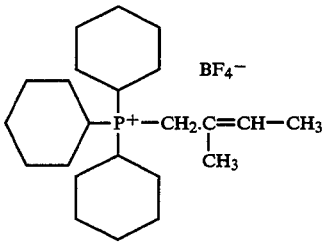
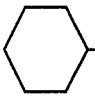
: cyclohexyl group
44
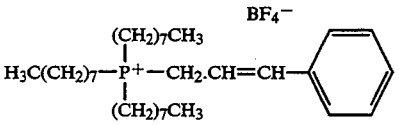
45
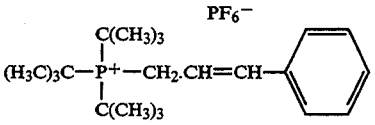
-continued
46
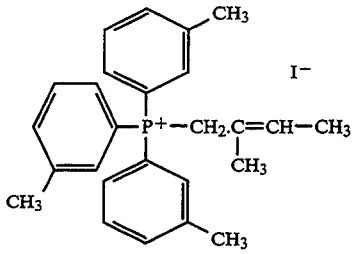
47
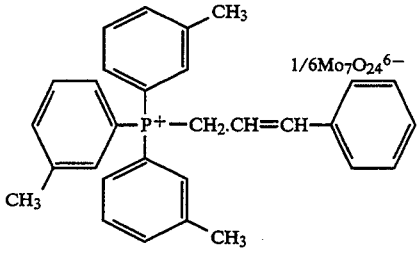
48
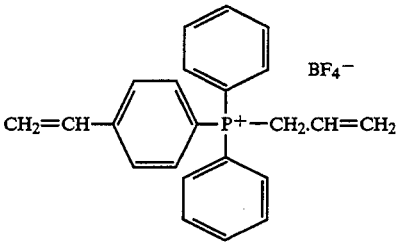
49
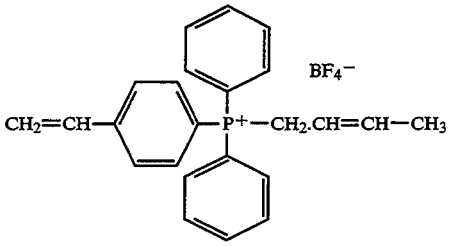
50
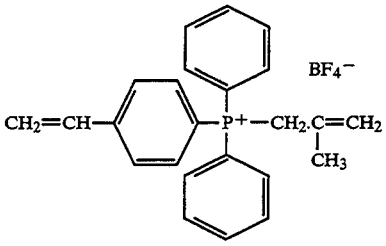
51
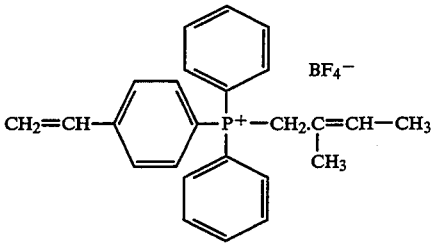

-continued
52
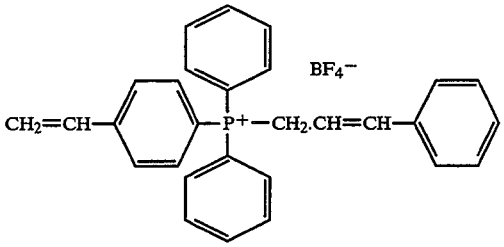
53
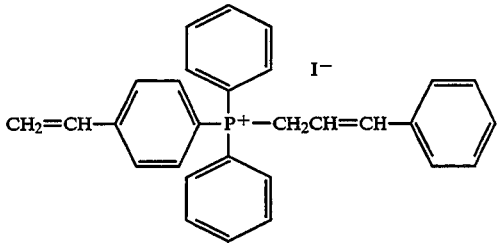
54
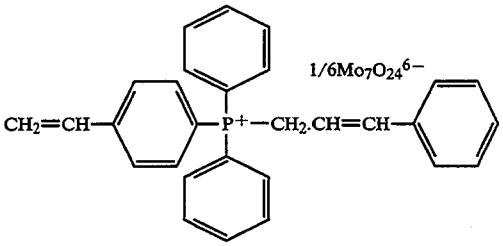
55
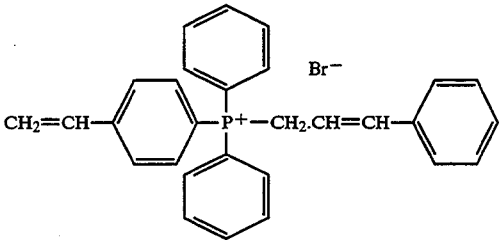
56
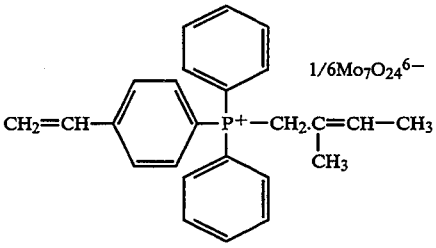
57
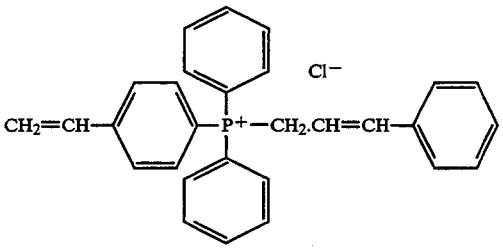
-continued
58
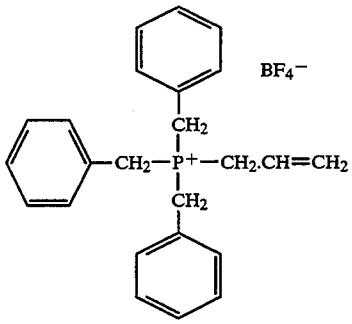
59
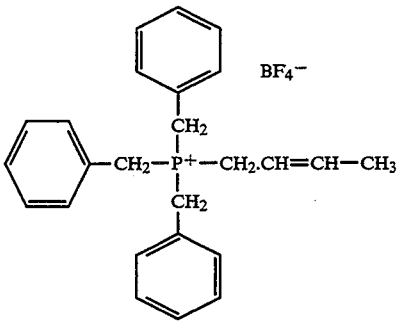
60
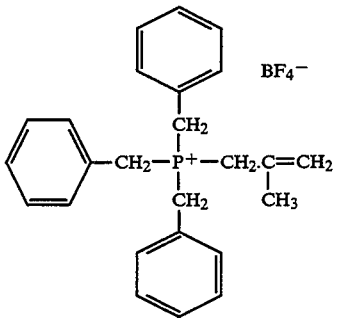
61
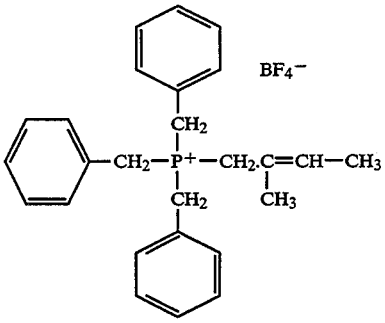
62
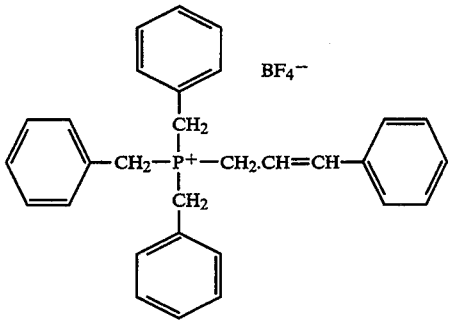

-continued
63
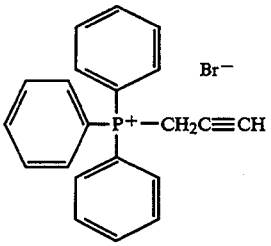
64
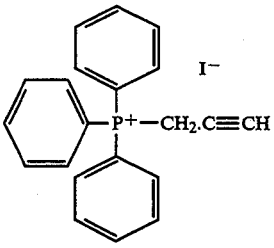
65
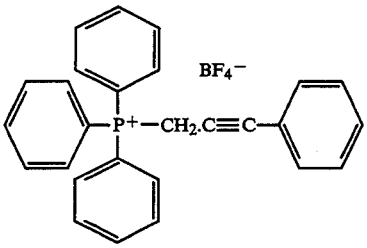
(66)
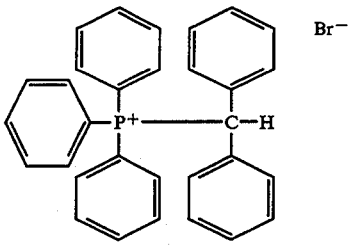
(67)
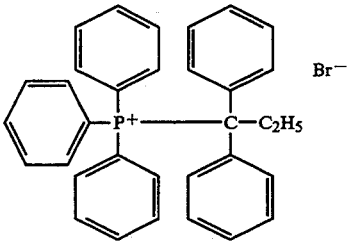
(68)
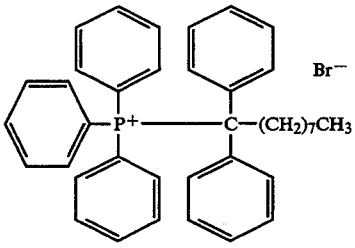
-continued
(69)
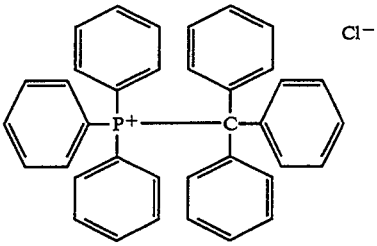
(70)
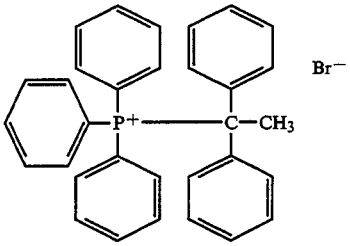
(71)
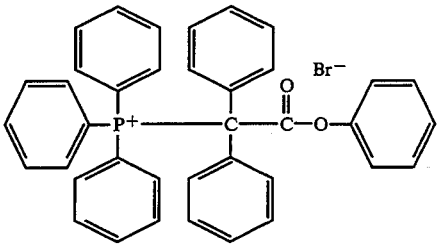
(72)
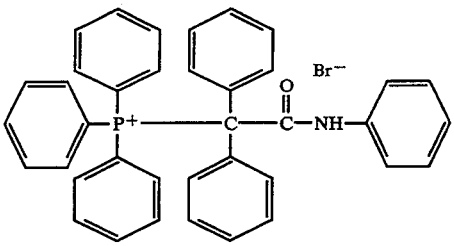
(73)
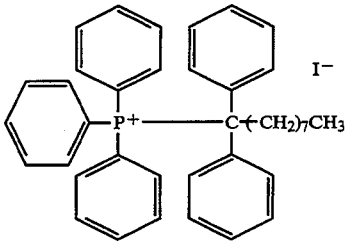
(74)
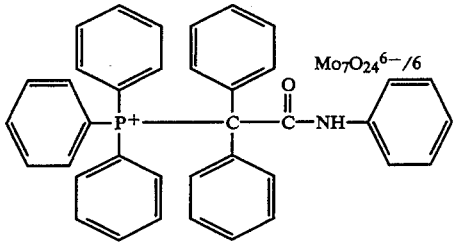

-continued
(75)
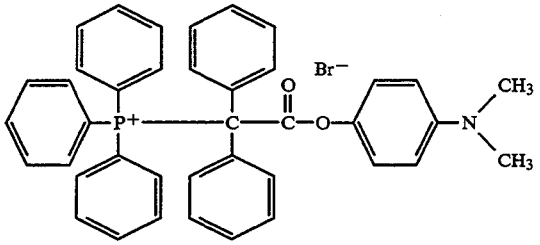
(76)
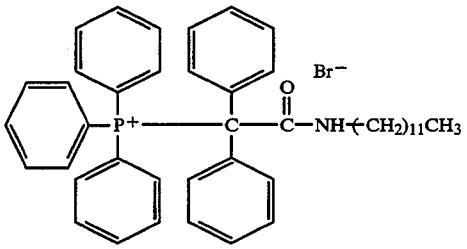
(77)
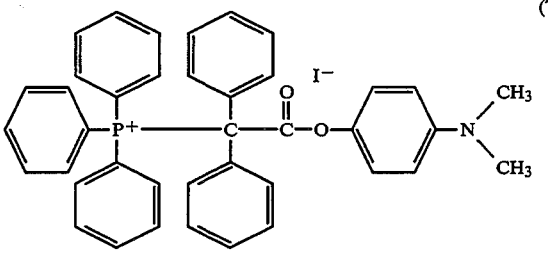
(78)
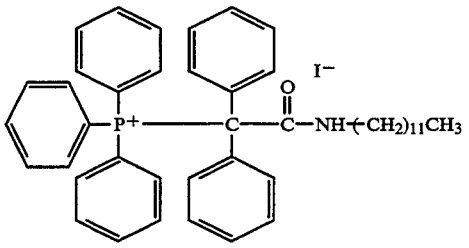
(79)
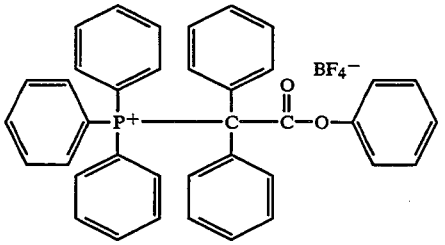
-continued
(80)
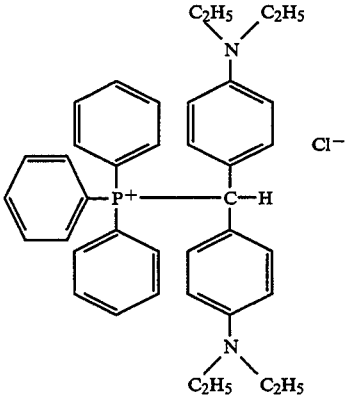
(81)
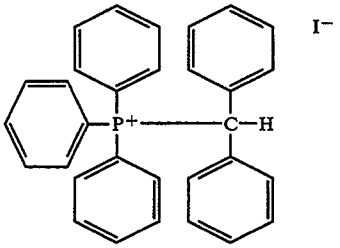
(82)
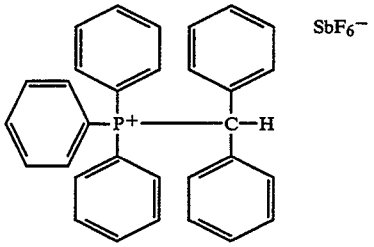
(83)
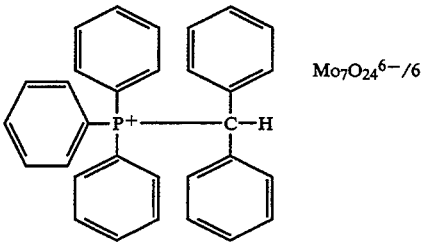
(84)
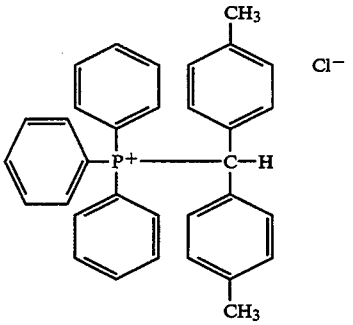

-continued
(85)
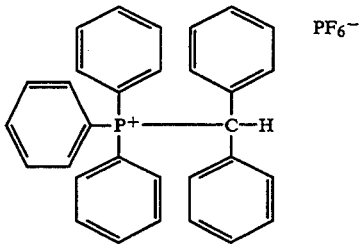
(86)
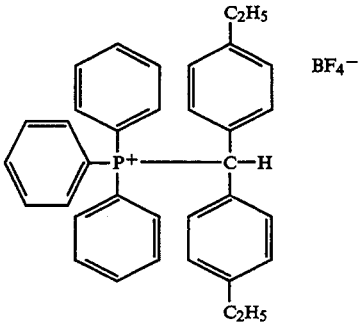
(87)
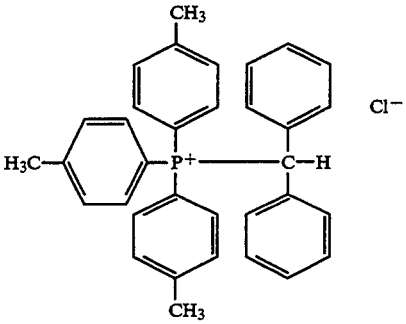
(88)
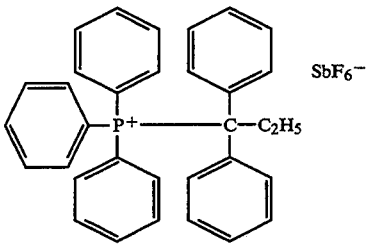
(89)
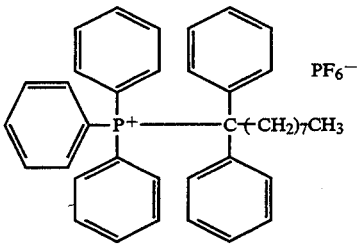
-continued
(90)
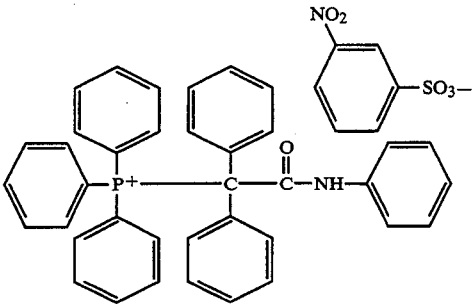
(91)
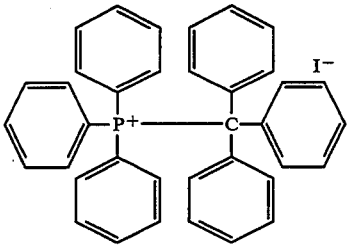
(92)
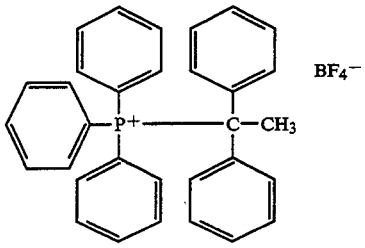
(93)
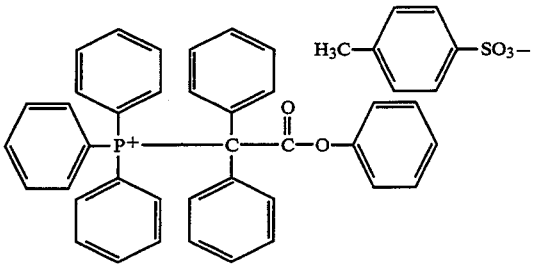
(94)
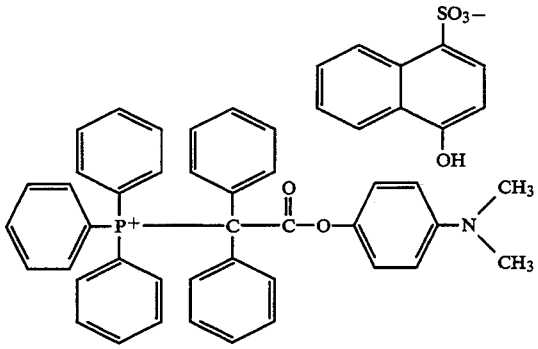

-continued
(95)
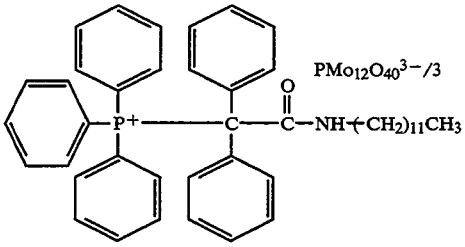
(96)
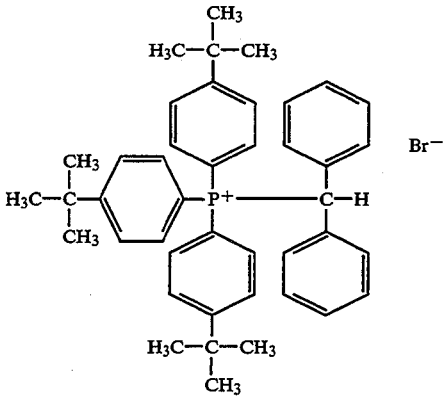
(97)
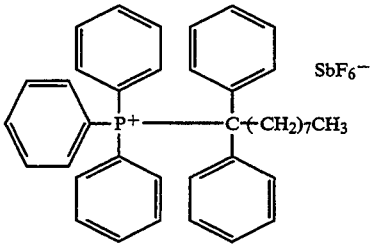
(98)
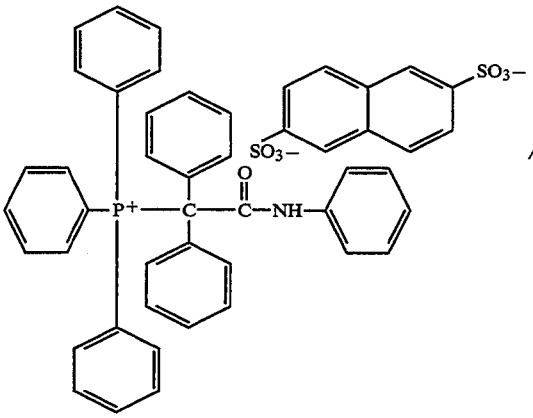
(99)
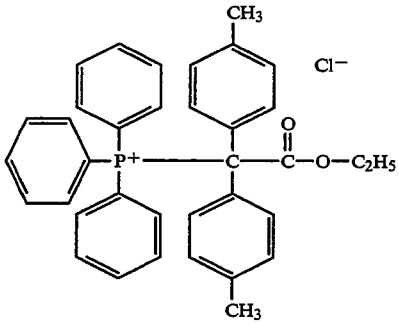
-continued
(100)
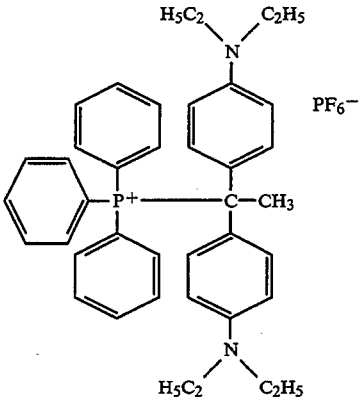
(101)
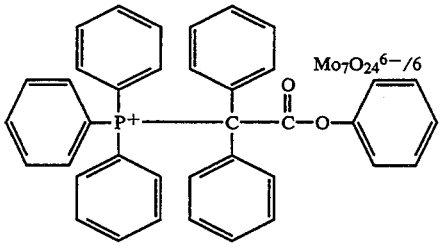
(102)
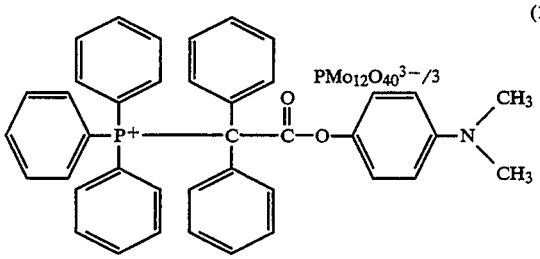
(103)
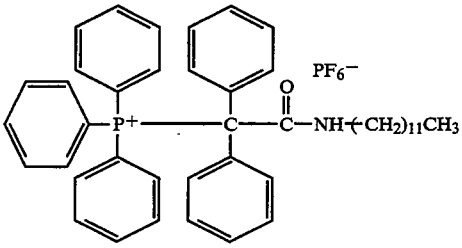
(104)
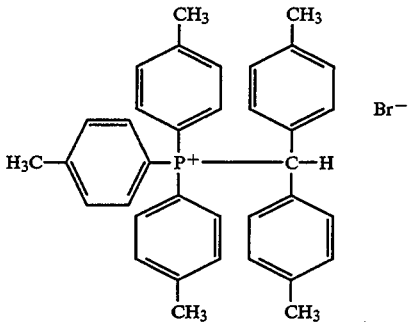

-continued
(105)
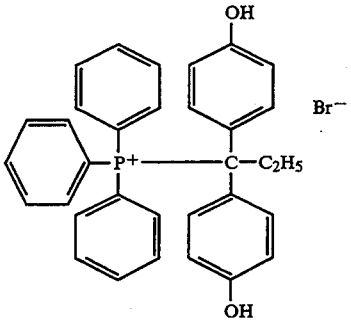
(106)
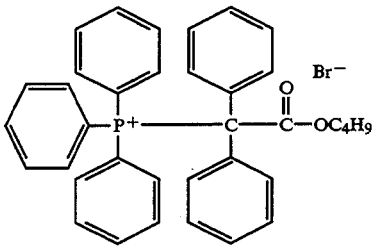
(107)
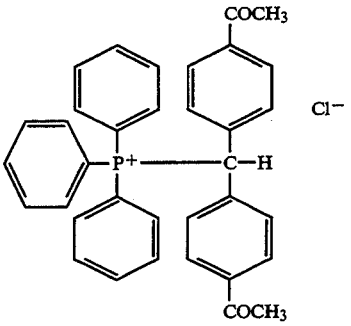
(108)
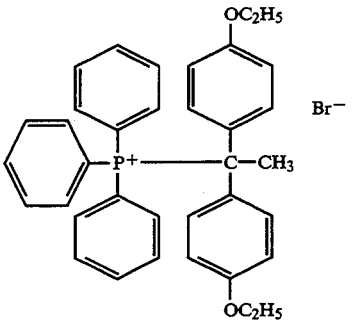
(109)
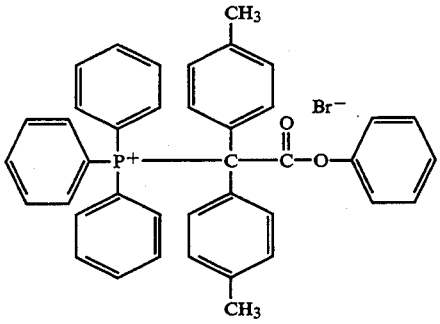
-continued
(110)
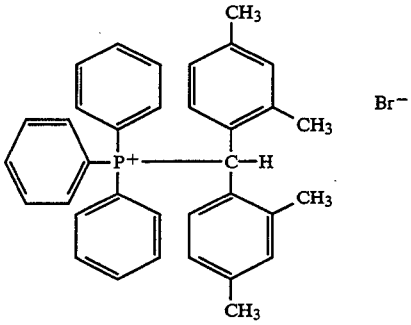
(111)
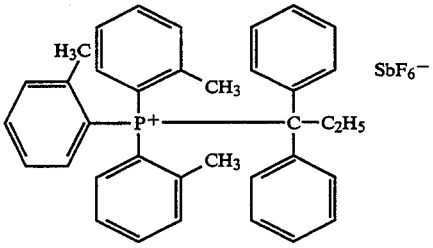
(112)
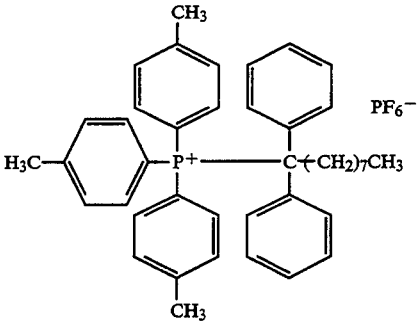
(113)
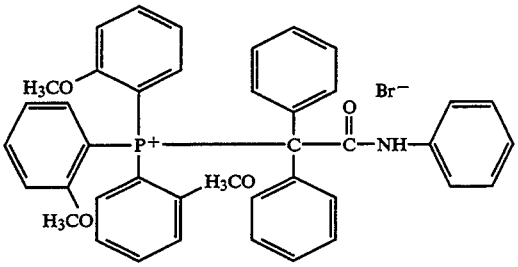
(114)
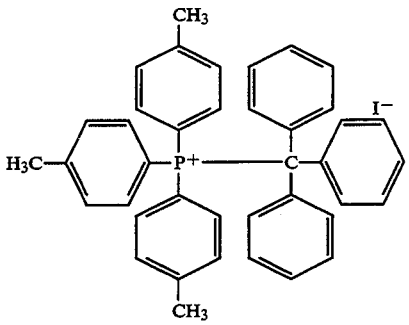

-continued
(115)
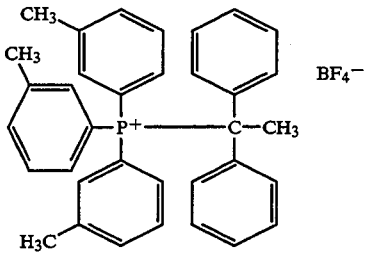
(116)
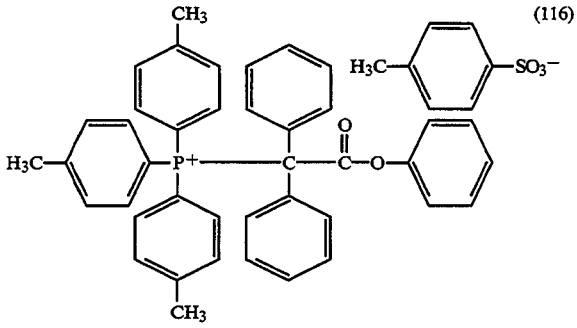
(117)
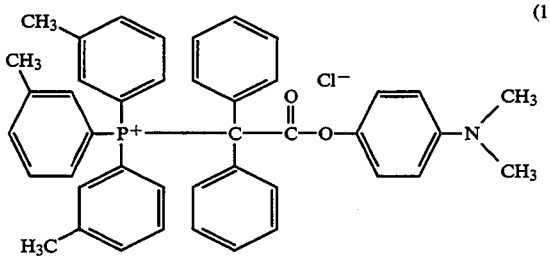
(118)
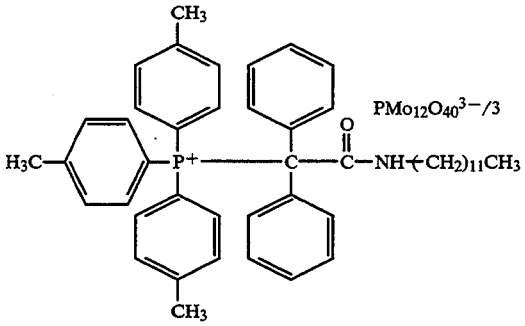
(119)
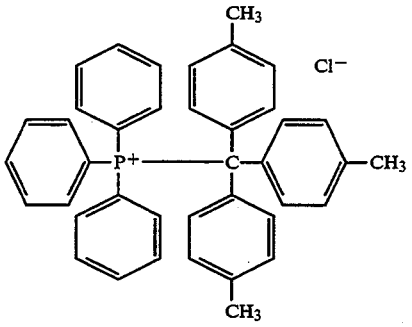
-continued
(120)
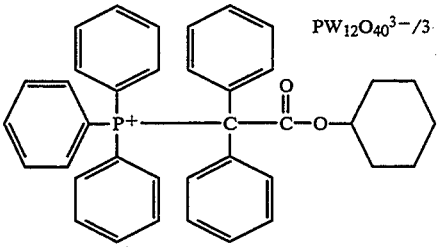
(121)
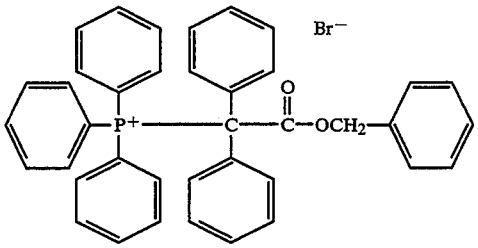
(122)
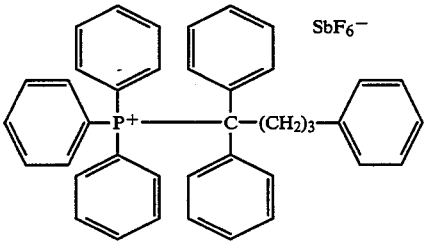
(123)
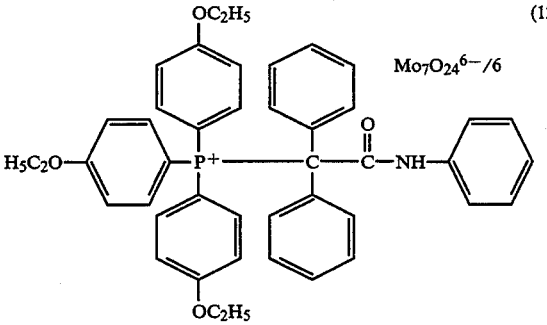
(124)
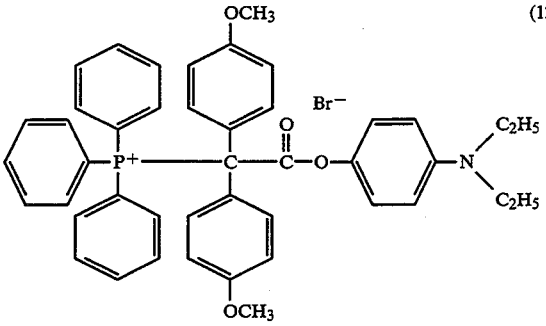

-continued (125)

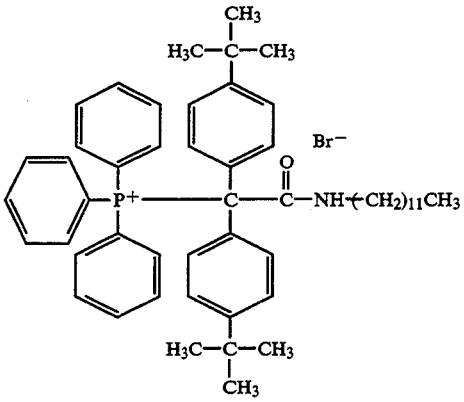

(126)

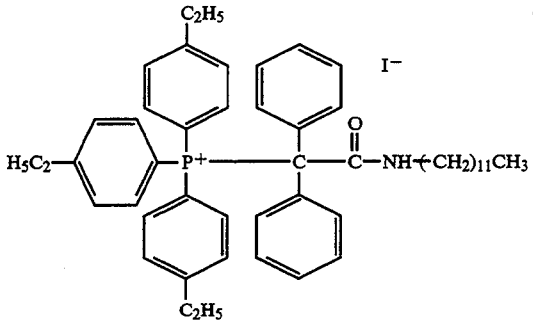

(127)

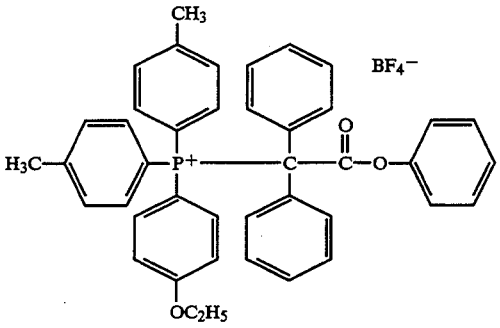

(128)

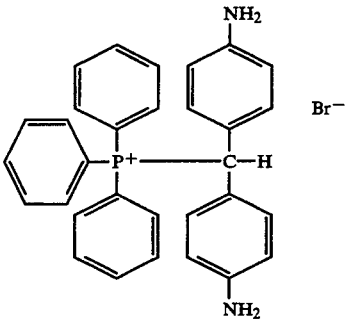

-continued (129)

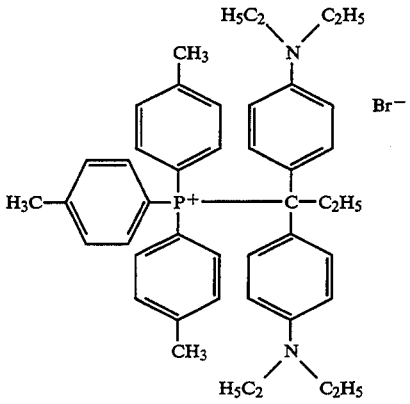

(130)

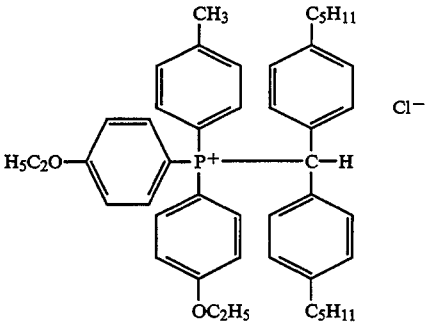

(131)

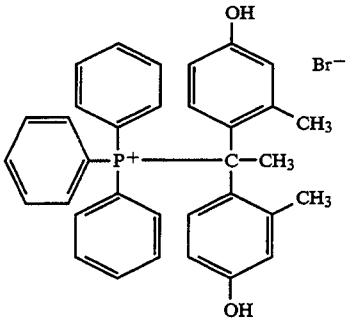

The compounds represented by the above formulae can be prepared by the conventional process as embodied in the following Synthetic Examples. In the formed phosphonium salt, the anion may be replaced by the other anion by the conventional process.

Synthetic Examples of the compounds of the present invention represented by the formula (1) will now be described. In the Synthetic Examples, "parts" means "parts by weight" unless otherwise specified.

Synthetic Example 1

86.7 parts of triphenylphosphine was dissolved in 200 parts of xylene and 40.0 parts of allyl bromide was added thereto. The mixture was gradually heated and allowed to react at 134° C. for 3 hr. After the mixture was cooled to 30° C., the resulting colorless crystals were collected by filtration and washed with toluene to obtain 122.7 parts of allyltriphenylphosphonium bromide (compound No. 16).

Synthetic Example 2

88.2 parts of triphenylphosphine was dissolved in 240 parts of xylene and 51.3 parts of cinnamyl chloride was added thereto. The mixture was heated at 130° C. for 4 hr. After the mixture was cooled to 30° C., the resulting colorless crystals were collected by filtration and washed with toluene to obtain 117.4 parts of cinnamyltriphenylphosphonium chloride (compound No. 15).

Synthetic Example 3

9.6 parts of allyltriphenylphosphonium bromide prepared in the above Synthetic Example 1 was dissolved in 140 parts of water and a solution of 2.8 parts of sodium tetrafluoroborate in 9 parts of water was slowly added dropwise thereto. After 5 hr stirring, the resulting colorless crystals were collected by filtration, washed with 200 parts of water, and dried to obtain 6.5 parts of allyltriphenylphosphonium tetrafluoroborate (compound No. 1).

Synthetic Example 4

69.2 parts of triphenylphosphine was dissolved in 200 parts of xylene and 23.9 parts of 2-butenyl chloride was added thereto. The mixture was heated at 125° C. for 5 hr. After the mixture was cooled to 30° C., the resulting colorless crystals were collected by filtration and washed with toluene to obtain 54.4 parts of 2-butenyltriphenylphosphonium chloride. 8.8 parts of 2-butenyltriphenylphosphonium chloride thus prepared was dissolved in 20 parts of water and a solution of 2.7 parts of sodium tetrafluoroborate in 9 parts of water was slowly added dropwise thereto. After 6 hr stirring, the resulting colorless crystals were collected by filtration, washed with 300 parts of water, and dried to obtain 8.5 parts of 2-butenyltriphenylphosphonium tetrafluoroborate (compound No. 2).

Synthetic Example 5

10.4 parts of cinnamyltriphenylphosphonium chloride prepared in the above Synthetic Example 2 was dissolved in 580 parts of water and a solution of 2.7 parts of sodium tetrafluoroborate in 9 parts of water was slowly added dropwise thereto. After 6 hr stirring, the resulting colorless crystals were collected by filtration, washed with 300 parts of water, and dried to obtain 10.1 parts of cinnamyltriphenylphosphonium tetrafluoroborate (compound No. 5).

Synthetic Example 6

10.4 parts of cinnamyltriphenylphosphonium chloride prepared in the above Synthetic Example 2 was dissolved in 580 parts of water and a solution of 5.2 parts of ammonium molibdate in 233 parts of water was slowly added dropwise thereto. After 5 hr stirring, the resulting colorless crystals were collected by filtration, washed with 300 parts of water, and dried to obtain 7.1 parts of cinnamyltriphenylphosphonium molibdate (compound No. 18).

Synthetic Example 7

6.2 parts of α-bromodiphenylmethane was dissolved in 100 parts of acetonitrile and 6.6 parts of triphenylphosphine was added thereto. The mixture was heated under reflux for 3 hr. The mixture was allowed to stand for cooling and then diluted with a small amount of diethyl ether. The resulting colorless crystals were collected by filtration and washed with a small amount of acetonitrile to obtain 10.5 parts of triphenyl (diphenylmethyl)phosphonium bromide (compound No. 66).

Synthetic Example 8

6.0 parts of trityl chloride was dissolved in 100 parts of acetonitrile and 5.7 parts of triphenylphosphine was added thereto. The mixture was heated under reflux for 6 hr. The mixture was allowed to stand for cooling and then the solvent was removed to obtain a brown oil which was then crystallized from acetone. The resulting crystals were collected by filtration and washed with acetone to obtain 9.2 parts of triphenyl(triphenylmethyl)phosphonium chloride (compound No. 69).

Synthetic Example 9

10 parts of triphenyl(diphenylmethyl)phosphonium bromide prepared in the above Synthetic Example 7 was dissolved in 100 parts of methanol. The resulting solution was added dropwise to 840 parts of an 3% aqueous solution of ammonium molibdate. Washing the resulting colorless crystals with water afforded 26 parts of triphenyl (diphenylmethyl)phosphonium molibdate (compound No. 83).

Synthetic Example 10

4.4 parts of ethyl 1-chloro-1,1-di(4-methylphenyl-)acetate was dissolved in 100 parts of acetonitrile and 5.7 parts of triphenylphosphine was added thereto. The mixture was heated under reflux for 8 hr. The mixture was allowed to stand for cooling, concentrated to one third of its original volume, and then diluted with 80 parts of diethyl ether by slow dropwise addition. The resulting colorless crystals were collected by filtration and washed with diethyl ether to obtain 8.1 parts of [1-ethoxycarbonyl-1,1-di(4-methylphenyl)methyl]triphenylphosphonium chloride (compound No. 99). Synthetic Example 11

10.3 parts of N-dodecyl-1-iodo-1,1-diphenylacetamide was dissolved in 150 parts of acetonitrile and 5.7 parts of triphenylphosphine was added thereto. The mixture was heated under reflux for 15 hr. The mixture was allowed to stand for cooling and then the solvent was removed to obtain a colorless oil. 100 parts of ether was added thereto under thorough stirring. The resulting colorless crystals were collected by filtration and washed to obtain 11.2 parts of [(dodecylaminocarbonyl-1,1-diphenyl)methyl]triphenylphosphonium iodide (compound No. 78).

A toner containing the compound represented by the above-described formula (1) can be prepared by a process which comprises kneading a mixture of a compound of the formula (1), a colorant and a binder resin in an apparatus capable of conducting heat mixing, such as a heat kneader and a twin roll, in such a state that the binder resin is in a molten state, cooling the kneaded product for solidification and pulverizing the solid into particles having a diameter of 3 to 20 μm by means of a pulverizer such as a jet mill and a ball mill. A process which comprises dissolving a colorant, a binder and a compound represented by the formula (1) in a solvent such as acetone and ethyl acetate, stirring the resultant solution, pouring the solution into water for re-precipitation, subjecting the precipitate to filtration and drying, pulverizing the dried solid into particles having a diameter of 3 to 20 μm by means of a pulverizer such as a ball mill, is also applicable. An alternative process comprises dispersing homogeneously into water a compound of the formula (1), a colorant and monomer(s) of a binder resin, polymerizing the monomer(s) in a form of fine particles under stirring to produce precipitates, converting the precipitates into a fine powder by successive filtration, washing with water and drying, and classifying the powder to obtain an aimed product having a particle diameter of 3 to 20 μm. Furthermore, a core material on soft particles (core particles) containing a low-melting resin for pressure fixing, a colorant, and magnetic substance, which is covered with a hard outer shell which provides protection and charge control functions can be used as microcapsule toner. In addition, the compound of the formula (1) alone or in combination with other additives such as colloidal silica can be fixed, by means of mechanochemical procedure or the like, on the surface of the colored fine particles containing no charge controlling material prepared according to one of the above mentioned processes.

In general, the proportion of the binder resin is 99 to 65% (by weight; the same shall apply hereinafter), preferably 98 to 85% the proportion of the colorant is 1.0 to 15% preferably 1.5 to 10%, and the proportion of the charge control agent is 0.1 to 30% preferably 0.5 to 5%

Examples of the colorant useable in the electrophotographic toner of the present invention include colorants known in the art, for example, inorganic pigments such as carbon black, ultramarine, iron black, active carbon, copper oxide, manganese dioxide, chrome yellow, zinc yellow, cadmium yellow, yellow iron oxide, Mineral Fast Yellow, nickel titanium yellow, red-colored chrome yellow, molibdenum orange, red iron oxide, cadmium red, manganese purple, titanium oxide, zinc sulfide, chrome green, chromium oxide, and antimony white; organic pigments such as C.I. (abbreviation for Color Index; the same shall apply hereinafter) Pigment Yellow 1, C.I. Pigment Red 9, C.I. Pigment Blue 15, Aniline Black, Naphthol Yellow S, Benzidine Yellow GR, Quinoline Yellow Lake, Anthrapyrimidine Yellow, Hansa Yellow G, Permanent Yellow NCG, Pyrazolone Orange, Indanethrene Brilliant Orange GK, Pyrazolone Red, Brilliant Carmine 6B, Rhodamine Lake B, Quinacridone, Alizarine Lake, Thioindigo Red, Thioindigo Maroon, Brilliant Carmine 3B, Methyl Violet Lake, Dioxadine Violet, Aniline Blue, Non-metallic Phthalocyanine Blue, Phthalocyanine Blue, Fast Sky Blue, Indanthrene Blue BC, Phthalocyanine Green, Malachite Green Lake, and Final Yellow Green G; and oil-soluble dyes such as C.I. Solvent Yellow 93, C.I. Solvent Red 146, C.I. Solvent Blue 35, C.I. Disperse Yellow 42, C.I. Disperse Red 59, C.I. Disperse Blue 81, C.I. Solvent Red 49, C.I. Solvent Red 52, C.I. Solvent Red 109, C.I. Basic Red 12, C.I. Basic Red 1, C.I. Direct Red 1, C.I. Acid Red 1, C.I. Basic Red 1, C.I. Direct Red 4, C.I. Mordant Red 30, C.I. Direct Blue 2, C.I. Acid Blue 9, C.I. Basic Blue 3, C.I. Basic Blue 5, C.I. Acid Blue 15, C.I. Mordant Blue 7.

Examples of the binder resin include polystyrene, a styrene-methacrylic acid copolymer, a styrene-methacylate copolymer, a styrene-acrylic acid copolymer, a styrene-acylate copolymer, a styrene-acrylonitrile copolymer, an acrylic resin, a styrene-maleic acid copolymer, polyvinyl chloride, polyvinyl acetate, an olefin resin, a polyester resin, a polyurethane resin and an epoxy resin. They may be used alone or in the form of a mixture thereof.

Examples of monomer(s) for preparing the binder resins include vinyl aromatic hydrocarbon monomers such as styrene, α-methylstyrene, vinyltoluene, chlorostyrene, ethylstyrene, and divinylbenzene; acrylic compound monomers such as acrylic acid, methacrylic acid, methyl acrylate, ethyl acrylate, butyl acrylate, 2-ethylhexyl acrylate, octyl acrylate, phenyl acrylate, methyl methacrylate, ethyl methacrylate, butyl methacrylate, 2-ethylhexyl methacrylate, octyl methacrylate, phenyl methacrylate; monocarboxylic acid derivatives having double bond such as acrylonitrile, methacrylonitrile and acrylamide; dicarboxylic acids and their derivatives such as maleic acid, methyl maleate, butyl maleate, dimethyl maleate, phthalic acid, succinic acid, and terephthalic acid; vinyl monomers such as ethylene, propylene, butylene, vinyl methyl ketone, vinyl hexyl ketone, vinyl methyl ether, and vinyl isobutyl ether; polyol compounds such as ethylene glycol, diethylene glycol, triethylene glycol, 1,2-propylene glycol, 1,3-propylene glycol, 1,4-butanediol, 1,6-hexanediol, bisphenol-A, hydrogenated bisphenol-A, and polyoxyethylenated bisphenol-A; isocyanates such as p-phenylene diisocyanate, p-xylylene diisocyanate, and 1,4-tetramethylene diisocyanate; amines such as ethylamine, butylamine, ethylenediamine, 1,4-dimaminobenzene, 1,4-diaminobutane, and monoethanolamine; and epoxy compounds such as diglycidyl ether, ethylene glycol diglycidyl ether, bisphenol-A glycidyl ether, and hydroquinone diglycidyl ether.

The electrophotographic toner of the present invention may be blended with optional additives, for example, fluidizers such as silicon oxide, anti-foggants such as mineral oils, various magnetic materials for one-component development, and conductive agents such as zinc oxide.

A carrier used for preparing a two-component toner is a material which will provide charge to particles of the toner when the carrier contacts with the toner particles. Examples of the carrier include iron powder carrier, glass beads carrier, ferrite carrier, and those coated with a resin.

The toner prepared in the present invention is mixed with, for example, an about 200-mesh iron powder (carrier) in a weight ratio of the toner to the iron powder of, for example, (3 to 8) (97 to 92) to prepare a developer for use in the step of development in the electrophotography.

Compared with toners wherein a conventional charge control agent is used, the electrophotographic toner of the present invention has a sharp distribution of the amount of electrification and a good time stability and therefore is characterized by a high capability of providing an image having a very high gradation and a very high capability of repeatedly forming an image.

EXAMPLE

The present invention will now be described in more detail by referring to the following Examples, though it is not limited to these Examples only.

In the Examples, "parts" are "parts by weight" unless otherwise specified.

EXAMPLE 1

| | |
|---|---|
| styrene-butyl acrylate copolymer (binder) | 100 parts |
| low molecular-weight polyethylene | 3 parts |
| C.I. Disperse Yellow 164 (colorant) | 1.2 parts |
| compound No. 1 | 1.5 parts |

A mixture having the above-described composition was subjected to a melt mixing treatment (for 10 min) in a kneader adjusted to a temperature from 120° to 140° C. and then cooled for solidification. Then, the solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer A. The developer A was then subjected to measurement of an initial specific electrification amount by means of a blow-off electrification amount measuring apparatus and found to be +25.8 μc/g. Further, the developer A was used for copying in a copying machine to give a clear yellow image having an excellent gradation without detrimental to the hue inherent in the colorant.

Further, the developer A was subjected to the charge stability test (a test for change in the amount of electrification with time and a test for change in the amount of electrification under a moist condition). The results are given in the following Table 1.

TABLE 1

| | Test for change in the amount of electrification with time (unit: +μc/g) | | | | | | |
|---|---|---|---|---|---|---|---|
| Time (hr) | 0.08 | 0.25 | 0.5 | 1 | 3 | 6 | 22 |
| Developer A | 25.8 | 22.0 | 20.4 | 18.0 | 14.5 | 10.8 | 11.6 |

| Test for change in the amount of electrification under moist condition (unit: +μc/g) | | |
|---|---|---|
| Initial | After test | Change (%) |
| 25.8 | 21.0 | −18.6 |

As is apparent from the above-described results, the developer A had a very excellent stability after the lapse of time.

The test for stability with time was conducted by the following methods.

Test for change in the amount of electrification with time:

A developer (a mixture of a toner with an iron powder carrier) A was weighed into a polyethylene vessel and subjected to ball milling at 120 rpm for 22 hr, thereby conducting contact electrification. At that time, the amount of electrification of the toner was measured at predetermined time intervals according to blow-off method.

Test for change in the amount of electrification under moist condition:

The toner was electrified for one hour in a polyethylene vessel in the same manner as that described above, and the polyethylene vessel was allowed to stand in an open state for two days in an atmosphere at a temperature of 34° C. and a humidity of 86% RH and subjected to ball milling at 120 rpm for 5 minutes to conduct contact electrification. The amount of electrification of the toner was measured according to the blow-off method.

The change was calculated as follows:

Change=[(the amount of electrification after the test under moist condition)—(the initial amount of electrification at normal temperature and humidity)]/(the initial amount of electrification at normal temperature and humidity)×100 (%)

EXAMPLE 2

| | |
|---|---|
| polyester resin (binder) | 100 parts |
| carbon black (colorant) | 6.0 parts |
| compound No. 2 | 1.5 parts |

A mixture having the above-described composition was subjected to a melt mixing treatment (for 10 min) in a kneader at a temperature adjusted to 120° to 140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the powder carrier in a weight ratio of the toner to the iron powder carrier of 3:97 to prepare developer B. The developer B was then subjected to measurement of an initial specific electrification amount by means of a blow-off electrification amount measuring apparatus and found to be +21.6 μc/g. Further, the developer B was used for copying in a copying machine to give a black image having an excellent gradation.

Further, the developer B was subjected to the test for stability with time in the same manner as that of Example 1. The results are given in the following Table 2.

TABLE 2

| | Test for change in the amount of electrification with time (unit: +μc/g) | | | | | | |
|---|---|---|---|---|---|---|---|
| Time (hr) | 0.08 | 0.25 | 0.5 | 1 | 3 | 6 | 22 |
| Developer B | 21.6 | 19.3 | 21.2 | 16.6 | 13.1 | 11.1 | 12.1 |

| Test for change in the amount of electrification under moist condition (unit: +μc/g) | | |
|---|---|---|
| Initial | After test | Change (%) |
| 21.6 | 22.4 | +3.7 |

As is apparent from the above-described results, the developer B had a very excellent stability after the lapse of time.

EXAMPLE 3

| | |
|---|---|
| styrene-methyl acrylate copolymer (binder) | 100 parts |
| low-molecular-weight polypropylene | 3 parts |
| C.I. Solvent Blue 111 (colorant) | 1.5 parts |
| compound No. 5 | 1.5 parts |

A mixture of these compounds was dissolved in 1000 parts of a solvent mixture of acetone and ethyl acetate, and the solution was stirred at room temperature for one hour. Then, the stirred mixture was added dropwise to 10000 parts of water while stirring for re-precipitation. The formed precipitates were collected by filtration and dried to prepare a toner in the coarse particle form. Subsequently, the toner was pulverized by means of a jet mill pulverizer and then classified by means of an air classifier to prepare a toner having a particle diameter of 5 to 20 μm. The toner thus prepared was mixed with an about 200-mesh iron powder carrier in a weight ratio of the toner to the iron powder carrier of 3:97 to prepare developer C. The developer C was then subjected to measurement of an initial specific electrification amount by means of a blow-off electrification amount measuring apparatus and found to be +25.6 μc/g. Further, the developer C was used for copying in a copying machine to give a clear blue image having an excellent gradation without detriment to the hue inherent in the colorant.

Further, the developer C was subjected to the test for stability with time in the same manner as that of Example 1. The results are given in the following Table 3.

TABLE 3

| Test for change in the amount of electrification with time (unit: +μc/g) | | | | | | | |
|---|---|---|---|---|---|---|---|
| Time (hr) | 0.08 | 0.25 | 0.5 | 1 | 3 | 6 | 22 |
| Developer C | 25.6 | 24.3 | 23.5 | 22.0 | 18.5 | 15.9 | 16.5 |

| Test for change in the amount of electrification under moist condition (unit: +μc/g) | | |
|---|---|---|
| Initial | After test | Change (%) |
| 25.6 | 30.2 | +16.6 |

AS is apparent from the above-described results, the developer C had a very excellent stability after the lapse of time.

EXAMPLE 4

| | |
|---|---|
| epoxy resin (binder) | 100 parts |
| C.I. Disperse Red 60 (colorant) | 1.2 parts |
| C.I. Disperse Violet 17 (colorant) | 0.3 parts |
| compound No. 9 | 2.0 parts |

A mixture having the above-described composition was subjected to a melt mixing treatment in a kneader at a temperature adjusted to 110° to 130° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer D. The developer D was then subjected to measurement of an initial specific electrification amount by means of a blow-off electrification amount measuring apparatus and found to be +25.3 μc/g. Further, the developer D was used for copying in a copying machine to give a clear red image having an excellent gradation without detriment to the hue inherent in the colorant.

Further, the developer D was subjected to the test for stability with time in the same manner as that of Example 1. The results are given in the following Table 4.

TABLE 4

| Test for change in the amount of electrification with time (unit: +μc/g) | | | | | | | |
|---|---|---|---|---|---|---|---|
| Time (hr) | 0.08 | 0.25 | 0.5 | 1 | 3 | 6 | 22 |
| Developer D | 25.3 | 24.1 | 22.5 | 21.3 | 20.6 | 21.4 | 21.0 |

| Test for change in the amount of electrification under moist condition (unit: +μc/g) | | |
|---|---|---|
| Initial | After test | Change (%) |
| 25.3 | 25.1 | −0.8 |

As is apparent form the above-described results, the developer D had a very excellent stability after the lapse of time.

EXAMPLE 5

| | |
|---|---|
| epoxy resin (binder) | 100 parts |
| C.I. Disperse Red 60 (colorant) | 1.2 parts |
| compound No. 13 | 2.0 parts |

A mixture having the above-described composition was subjected to a melt mixing treatment in a kneader at a temperature adjusted to 120°–130° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer E. The developer E was then subjected to measurement of an initial specific electrification amount by means of a blow-off electrification amount measuring apparatus and found to be +38.0 μc/g. Further, the developer E was used for copying in a copying machine to give a clear red image having an excellent gradation without detriment to the hue inherent in the colorant.

Further, the developer E was subjected to the test for stability with time in the same manner as that of Example 1. The results are given in the following Table 5.

TABLE 5

| Test for change in the amount of 2 electrification with time (unit: +μc/g) | | | | | | | |
|---|---|---|---|---|---|---|---|
| Time (hr) | 0.08 | 0.25 | 0.5 | 1 | 3 | 6 | 22 |
| Developer E | 38.0 | 34.9 | 34.0 | 32.0 | 28.3 | 27.2 | 26.7 |

| Test for change in the amount of electrification under moist condition (unit: +μc/g) | | |
|---|---|---|
| Initial | After test | Change (%) |
| 38.0 | 36.1 | −5.0 |

As is apparent from the above-described results, the developer E had a very excellent stability after the lapse of time.

EXAMPLE 6

| | |
|---|---|
| styrene-butyl acrylate copolymer (binder) | 100 parts |
| low-molecular-weight polyethylene | 3 parts |
| Kayaset Yellow 963 (colorant) (a product of Nippon Kayaku Co., Ltd.) | 1.2 parts |
| compound No. 15 | 1.5 parts |

A mixture having the above-described composition was subjected to a melt mixing treatment (for 10 min) in a kneader at a temperature adjusted to 125°–140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer F. The developer F was then subjected to measurement of an initial specific electrification amount by means of a blow-off electrification amount measuring apparatus and found to be +39.2 μc/g. Further, the developer F was used for copying in a copying machine to give a clear yellow image having an excellent gradation without detriment to the hue inherent in the colorant.

Further, the developer F was subjected to the test for stability with time (a test for change in the amount of electrification with time and a test for change in the amount of electrification under a moist condition) in the same manner as that of Example 1. The results are given in the following Table 6.

TABLE 6

| Test for change in the amount of electrification with time (unit: +μc/g) | | | | | | | |
|---|---|---|---|---|---|---|---|
| Time (hr) | 0.08 | 0.25 | 0.5 | 1 | 3 | 6 | 22 |
| Developer F | 39.2 | 34.8 | 34.1 | 31.6 | 27.5 | 24.6 | 21.5 |

| Test for change in the amount of electrification under moist condition (unit: +μc/g) | | |
|---|---|---|
| Initial | After test | Change (%) |
| 39.2 | 32.1 | −18.1 |

As is apparent from the above-described results, the developer F had a very excellent stability after the lapse of time.

EXAMPLE 7

| | |
|---|---|
| methyl styrene monomer | 75 parts |
| ethyl acrylate monomer | 20 parts |
| Kayaset Blue 814 (colorant) (a product of Nippon Kayaku Co., Ltd.) | 1.8 parts |
| benzoyl peroxide | 6 parts |
| compound No. 18 | 2 parts |

A mixture having the above-described composition was mixed for 5 minutes using a homo-mixer to form a homogeneous liquid. The liquid was added to a dispersion of 2.3 parts of magnesium carbonate in 120 parts of water, followed by mixing in a homo-mixer at 6500 rpm for 5 minutes to obtain a homogeneous suspension. The suspension was then placed in a 300 ml three-necked flask and the polymerization was carried out at 70° C. for 5 hr under stirring at 200 rpm. After the mixture was cooled to 40° C., 90 parts of 5% diluted hydrochloric acid was added thereto. The resulting precipitates were collected by filtration, washed with water, and dried at 40° C. to obtain a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer G. The developer G was then subjected to measurement of an initial specific electrification amount by means of a blow-off electrification amount measuring apparatus and found to be +21.2 μc/g. Further, the developer G was used for copying in a copying machine to give a clear yellow image having an excellent gradation without detriment to the hue inherent in the colorant.

Further, the developer G was subjected to the test for stability with time (a test for change in the amount of electrification with time and a test for change in the amount of electrification under a moist condition) in the same manner as that of Example 1. The results are given in the following Table 7.

TABLE 7

| Test for change in the amount of electrification with time (unit: +μc/g) | | | | | | | |
|---|---|---|---|---|---|---|---|
| Time (hr) | 0.08 | 0.25 | 0.5 | 1 | 3 | 6 | 22 |
| Developer G | 21.2 | 30.8 | 31.4 | 33.3 | 32.5 | 30.5 | 28.4 |

| Test for change in the amount of electrification under moist condition (unit: +μc/g) | | |
|---|---|---|
| Initial | After test | Change (%) |
| 21.2 | 23.1 | +9.0 |

As is apparent from the above-described results, the developer G had a very excellent stability after the lapse of time.

EXAMPLES 8 to 45

Developers were prepared in the same manner as that of Example 1 through the use of compounds listed in the column of "Compound" and colorants listed in the column of "Colorant" of tables 8 to 13, and the formed toners were each subjected to measurement of an initial specific electrification amount and a specific electrification amounts with time (referred to as "After test" in the following tables) in the same manner as that of Example 1.

As a result, it was found that the toners wherein use was made of any of the compounds exhibited less susceptibility to a change in the amount of electrification and the developers had a very excellent stability after the lapse of time. Copying was conducted by means of a copying machine to give a result wherein all of the developers provided a clear image having an excellent gradation and the hue inherent in the colorant.

TABLE 8

| Test for change in the amount of electrification with time (unit: +μC/g) | | | | | | | | | |
|---|---|---|---|---|---|---|---|---|---|
| Example No. | Compound No. | Colorant | Time (h) 0.08 | 0.25 | 0.5 | 1 | 3 | 6 | 22 |
| 8 | 3 | CI.Dis.Y.164 | 25.8 | 25.0 | 22.6 | 20.5 | 19.7 | 17.6 | 18.1 |
| 9 | 4 | " | 22.3 | 23.4 | 20.8 | 19.9 | 14.5 | 14.3 | 14.8 |
| 10 | 6 | " | 23.1 | 21.4 | 20.2 | 20.5 | 18.7 | 13.6 | 12.9 |
| 11 | 7 | " | 21.2 | 20.9 | 19.5 | 17.5 | 14.8 | 14.4 | 14.9 |
| 12 | 8 | CI.Pig.R.9 | 24.3 | 22.2 | 20.9 | 18.6 | 17.3 | 17.5 | 17.5 |
| 13 | 10 | " | 26.2 | 26.3 | 26.3 | 26.5 | 26.8 | 26.4 | 25.0 |
| 14 | 11 | " | 17.6 | 17.4 | 17.0 | 16.9 | 16.6 | 15.9 | 13.8 |

| Test for change in the amount of electrification under moist condition (unit: +μC/g) | | | | |
|---|---|---|---|---|
| Example No. | Compound No. | Initial | After test | Change (%) |
| 8 | 3 | 25.8 | 20.1 | −22.1 |
| 9 | 4 | 22.3 | 21.9 | −1.8 |
| 10 | 6 | 23.1 | 19.5 | −15.6 |
| 11 | 7 | 21.2 | 20.2 | −4.7 |
| 12 | 8 | 24.3 | 19.6 | −19.3 |
| 13 | 10 | 26.2 | 25.8 | −1.5 |

TABLE 8-continued

| | | | | |
|---|---|---|---|---|
| 14 | 11 | 17.6 | 15.3 | −13.1 |

Colorant CI.: Color Index, Sol: Solvent
Dis: Disperse, Pig: Pigment, B: Blue, R: Red, Y: Yellow,
Kayaset is a trade name (NIPPON KAYAKU CO., LTD.)

TABLE 9

Test for change in the amount of electrification with time (unit: +μC/g)

| Example No. | Compound No. | Colorant | Time (h) 0.08 | 0.25 | 0.5 | 1 | 3 | 6 | 22 |
|---|---|---|---|---|---|---|---|---|---|
| 15 | 12 | " | 21.9 | 19.3 | 19.5 | 18.5 | 17.0 | 15.4 | 12.1 |
| 16 | 14 | " | 20.7 | 19.9 | 19.9 | 18.4 | 16.6 | 15.6 | 13.4 |
| 17 | 16 | CI.Pig.Y.1 | 23.8 | 22.6 | 22.9 | 21.1 | 20.3 | 18.0 | 15.6 |
| 18 | 20 | " | 34.8 | 32.6 | 32.9 | 30.8 | 29.4 | 27.8 | 25.8 |
| 19 | 21 | CI.Sol.R.146 | 25.6 | 24.6 | 22.2 | 20.3 | 18.4 | 18.3 | 19.5 |
| 20 | 22 | " | 25.2 | 24.5 | 25.5 | 20.8 | 18.8 | 18.9 | 19.3 |
| 21 | 23 | Kayaset.Y.963 | 27.9 | 28.6 | 25.4 | 23.0 | 20.6 | 20.4 | 21.4 |
| 22 | 24 | " | 27.2 | 28.2 | 27.3 | 27.4 | 26.0 | 25.6 | 23.9 |
| 23 | 25 | " | 23.7 | 22.9 | 21.8 | 20.6 | 19.5 | 19.8 | 17.1 |
| 24 | 26 | " | 25.0 | 25.1 | 25.1 | 25.8 | 24.4 | 24.6 | 23.2 |
| 25 | 27 | CI.Pig.R.146 | 22.3 | 20.3 | 21.0 | 18.4 | 16.8 | 17.2 | 17.8 |
| 26 | 28 | " | 31.5 | 27.6 | 27.2 | 25.8 | 21.4 | 21.8 | 20.1 |

Test for change in the amount of electrification under moist condition (unit: +μC/g)

| Example No. | Compound No. | Initial | After test | Change (%) |
|---|---|---|---|---|
| 15 | 12 | 21.9 | 20.8 | −5.0 |
| 16 | 14 | 20.7 | 20.1 | −2.9 |
| 17 | 16 | 23.8 | 19.7 | −17.2 |
| 18 | 20 | 34.8 | 27.9 | −19.8 |
| 19 | 21 | 25.6 | 20.1 | −21.5 |
| 20 | 22 | 25.2 | 24.3 | −3.6 |
| 21 | 23 | 27.9 | 22.6 | −19.0 |
| 22 | 24 | 27.2 | 27.0 | −0.7 |
| 23 | 25 | 23.7 | 28.1 | +18.6 |
| 24 | 26 | 25.0 | 23.7 | −5.2 |
| 25 | 27 | 22.3 | 21.2 | −1.0 |
| 26 | 28 | 31.5 | 25.3 | −19.7 |

TABLE 10

Test for change in the amount of electrification with time (unit: +μC/g)

| Example No. | Compound No. | Colorant | Time (h) 0.08 | 0.25 | 0.5 | 1 | 3 | 6 | 22 |
|---|---|---|---|---|---|---|---|---|---|
| 27 | 29 | CI.Dis.R.60 | 23.9 | 22.7 | 20.5 | 20.1 | 20.0 | 20.3 | 18.2 |
| 28 | 30 | CARBON BLACK | 22.5 | 20.7 | 19.9 | 17.6 | 16.8 | 12.4 | 13.2 |
| 29 | 31 | " | 23.0 | 22.2 | 23.1 | 19.9 | 16.5 | 14.4 | 14.9 |
| 30 | 34 | CI.Pig.R.146 | 38.5 | 34.5 | 34.8 | 31.6 | 28.9 | 25.5 | 22.6 |
| 31 | 35 | " | 38.7 | 35.1 | 32.2 | 32.8 | 30.4 | 28.6 | 25.3 |
| 32 | 36 | CI.Sol.B.111 | 27.8 | 26.1 | 25.0 | 24.6 | 21.5 | 19.8 | 19.5 |
| 33 | 38 | " | 22.7 | 20.8 | 19.2 | 17.0 | 16.5 | 12.3 | 12.9 |
| 34 | 40 | CI.Dis.R.60 | 25.9 | 23.8 | 20.7 | 16.7 | 16.9 | 14.6 | 15.7 |
| 35 | 42 | CI.Dis.B.81 | 26.4 | 24.8 | 23.4 | 23.2 | 20.3 | 18.7 | 19.1 |
| 36 | 44 | " | 15.4 | 16.0 | 16.4 | 14.7 | 13.9 | 11.5 | 11.4 |
| 37 | 46 | CI.Dis.B.35 | 22.1 | 20.4 | 22.5 | 18.6 | 15.4 | 13.9 | 14.5 |
| 38 | 47 | " | 23.2 | 30.8 | 31.2 | 33.7 | 32.0 | 30.5 | 28.7 |

Test for change in the amount of electrification under moist condition (unit: +μC/g)

| Example No. | Compound No. | Initial | After test | Change (%) |
|---|---|---|---|---|
| 27 | 29 | 23.9 | 20.7 | −13.4 |
| 28 | 30 | 22.5 | 18.0 | −20.0 |
| 29 | 31 | 23.0 | 22.1 | −3.9 |
| 30 | 34 | 38.5 | 31.1 | −19.2 |
| 31 | 35 | 38.7 | 32.5 | −16.0 |
| 32 | 36 | 27.8 | 28.3 | +1.8 |
| 33 | 38 | 22.7 | 19.2 | −15.4 |
| 34 | 40 | 25.9 | 22.7 | −12.4 |
| 35 | 42 | 26.4 | 28.5 | +8.0 |
| 36 | 44 | 15.4 | 13.9 | −9.7 |
| 37 | 46 | 22.1 | 21.8 | −1.4 |
| 38 | 47 | 23.2 | 22.9 | −1.3 |

TABLE 11

Test for change in the amount of electrification with time

TABLE 11-continued

| Example No. | Compound No. | Colorant | (unit: +μC/g) Time (h) 0.08 | 0.25 | 0.5 | 1 | 3 | 6 | 22 |
|---|---|---|---|---|---|---|---|---|---|
| 39 | 48 | CI.Dis.R.60 | 22.3 | 21.0 | 20.9 | 18.8 | 15.7 | 11.9 | 12.5 |
| 40 | 52 | CARBON BLACK | 25.8 | 24.4 | 23.7 | 22.9 | 18.5 | 16.7 | 16.7 |
| 41 | 54 | " | 23.8 | 29.6 | 30.3 | 32.0 | 31.2 | 29.9 | 27.5 |
| 42 | 57 | CI.Pig.R.146 | 32.4 | 32.6 | 32.9 | 31.0 | 26.8 | 23.4 | 20.9 |
| 43 | 58 | " | 27.7 | 25.1 | 21.2 | 20.8 | 20.4 | 18.6 | 16.2 |
| 44 | 62 | " | 27.7 | 26.1 | 25.2 | 24.8 | 20.4 | 17.6 | 18.1 |
| 45 | 65 | " | 28.1 | 24.1 | 22.2 | 20.8 | 17.4 | 13.6 | 13.8 |

Test for change in the amount of electrification under moist condition (unit: +μC/g)

| Example No. | Compound No. | Initial | After test | Change (%) |
|---|---|---|---|---|
| 39 | 48 | 22.3 | 17.9 | −19.7 |
| 40 | 52 | 25.8 | 28.0 | +8.5 |
| 41 | 54 | 23.8 | 23.1 | −1.0 |
| 42 | 57 | 32.4 | 25.3 | −21.9 |
| 43 | 58 | 27.7 | 22.9 | −17.3 |
| 44 | 62 | 27.7 | 24.1 | −13.0 |
| 45 | 65 | 28.7 | 23.0 | −19.9 |

EXAMPLE 46

| | |
|---|---|
| styrene-butyl acrylate copolymer (binder) | 100 parts |
| low molecular-weight polyethylene | 3 parts |
| C.I. Disperse Yellow 164 (colorant) | 1.2 parts |
| compound No. 66 | 1.5 parts |

A mixture having the above-described composition was subjected to a melt mixing treatment (for 10 min) in a kneader adjusted to a temperature from 120° to 140° C. and then cooled for solidification.

The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer H. The developer H was then subjected to measurement of an initial specific electrification amount by means of a blow-off electrification amount measuring apparatus and found to be +40.1 μc/g. Further, the developer H was used for copying in a copying machine to give a clear yellow image having an excellent gradation without detrimental to the hue inherent in the colorant.

Further, the developer H was subjected to the charge stability test (a test for change in the amount of electrification with time and a test for change in the amount of electrification under a moist condition). The results are given in the following Table 12.

TABLE 12

| Test for change in the amount of electrification with time (unit: +μc/g) | | | | | | |
|---|---|---|---|---|---|---|
| Time (hr) | 0.25 | 0.5 | 1.0 | 2.0 | 4.0 | 6.0 |
| Developer H | 40.1 | 41.4 | 39.7 | 38.6 | 40.6 | 37.9 |

| Test for change in the amount of electrification under moist condition (unit: +μc/g) | | |
|---|---|---|
| Initial | After test | Change (%) |
| 40.1 | 34.3 | −14.5 |

As is apparent from the above-described results, the developer H had a very excellent stability after the lapse of time.

The test for stability with time was conducted by the following methods.

Test for change in the amount of electrification with time:

A developer (a mixture of a toner with an iron powder carrier) A was weighed into a polyethylene vessel and subjected to ball milling at 120 rpm for 6 hr, thereby conducting contact electrification. At that time, the amount of electrification of the toner was measured at predetermined time intervals according to blow-off method.

Test for change in the amount of electrification under moist condition:

The toner was electrified for one hour in a polyethylene vessel in the same manner as that described above, and the polyethylene vessel was allowed to stand in an open state for two days in an atmosphere at a temperature of 35° C. and a humidity of 90% RH and subjected to ball milling at 120 rpm for 15 minutes to conduct contact electrification. The amount of electrification of the toner was measured according to blow-off method.

EXAMPLE 47

| | |
|---|---|
| polyester resin (binder) | 100 parts |
| carbon black (colorant) | 6.0 parts |
| compound No. 69 | 1.5 parts |

A mixture having the above-described composition was subjected to a melt mixing treatment (for 10 min) in a kneader at a temperature adjusted to 120° to 140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the powder carrier in a weight ratio of the toner to the iron powder carrier of 3:97 to prepare developer I. The developer I was then subjected to measurement of an initial specific electrification amount by means of a blow-off electrification amount measuring apparatus and found to be +37.4 μc/g. Further, the developer I was used for copying in a copying machine to give a black image having an excellent gradation.

Further, the developer I was subjected to the test for stability with time in the same manner as that of Example 46. The results are given in the following Table 13.

TABLE 13

| | Test for change in the amount of electrification with time (unit: +μc/g) | | | | | |
|---|---|---|---|---|---|---|
| Time (hr) | 0.25 | 0.5 | 1.0 | 2.0 | 4.0 | 6.0 |
| Developer I | 37.4 | 37.9 | 35.1 | 36.3 | 35.9 | 35.0 |

| Test for change in the amount of electrification under moist condition (unit: +μc/g) | | |
|---|---|---|
| Initial | After test | Change (%) |
| 37.4 | 35.8 | −4.3 |

As is apparent from the above-described results, the developer I had a very excellent stability after the lapse of time.

EXAMPLE 48

| | |
|---|---|
| styrene-methyl acrylate copolymer (binder) | 100 parts |
| low-molecular-weight polypropylene | 3 parts |
| C.I. Solvent Blue 111 (colorant) | 1.5 parts |
| compound No. 72 | 1.5 parts |

A mixture of these compounds was dissolved in 1000 parts of a solvent mixture of acetone and ethyl acetate, and the solution was stirred at room temperature for one hour. Then, the stirred mixture was added dropwise to 10000 parts of water while stirring for re-precipitation. The formed precipitates were collected by filtration and dried to prepare a toner in the coarse particle form. Subsequently, the toner was pulverized by means of a jet mill pulverizer and then classified by means of an air classifier to prepare a toner having a particle diameter of 5 to 20 μm. The toner thus prepared was mixed with an about 200-mesh iron powder carrier in a weight ratio of the toner to the iron powder carrier of 3:97 to prepare developer J. The developer J was then subjected to measurement of an initial specific electrification amount by means of a blow-off electrification amount measuring apparatus and found to be +29.6 μc/g. Further, the developer J was used for copying in a copying machine to give a clear blue image having an excellent gradation without detriment to the hue inherent in the colorant.

Further, the developer J was subjected to the test for stability with time in the same manner as that of Example 46. The results are given in the following Table 14.

TABLE 14

| | Test for change in the amount of electrification with time (unit: +μc/g) | | | | | |
|---|---|---|---|---|---|---|
| Time (hr) | 0.25 | 0.5 | 1.0 | 2.0 | 4.0 | 6.0 |
| Developer J | 34.2 | 35.9 | 33.9 | 33.0 | 34.8 | 33.1 |

| Test for change in the amount of electrification under moist condition (unit: +μc/g) | | |
|---|---|---|
| Initial | After test | Change (%) |
| 34.2 | 29.5 | −13.7 |

As is apparent from the above-described results, the developer J had a very excellent stability after the lapse of time.

EXAMPLE 49

| | |
|---|---|
| epoxy resin (binder) | 100 parts |
| C.I. Disperse Red 60 (colorant) | 1.2 parts |
| C.I. Disperse Violet 17 (colorant) | 0.3 parts |
| compound No. 75 | 2.0 parts |

A mixture having the above-described composition was subjected to a melt mixing treatment in a kneader at a temperature adjusted to 110° to 130° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer K. The developer K was then subjected to measurement of an initial specific electrification amount by means of a blow-off electrification amount measuring apparatus and found to be +28.3 μc/g. Further, the developer K was used for copying in a copying machine to give a clear red image having an excellent gradation without detriment to the hue inherent in the colorant.

Further, the developer K was subjected to the test for stability with time in the same manner as that of Example 46. The results are given in the following Table 15.

TABLE 15

| | Test for change in the amount of electrification with time (unit: +μc/g) | | | | | |
|---|---|---|---|---|---|---|
| Time (hr) | 0.25 | 0.5 | 1.0 | 2.0 | 4.0 | 6.0 |
| Developer K | 41.1 | 42.0 | 40.8 | 40.3 | 41.7 | 42.3 |

| Test for change in the amount of electrification under moist condition (unit: +μc/g) | | |
|---|---|---|
| Initial | After test | Change (%) |
| 42.3 | 40.1 | −5.2 |

As is apparent form the above-described results, the developer K had a very excellent stability after the lapse of time.

EXAMPLE 50

| | |
|---|---|
| epoxy resin (binder) | 100 parts |
| C.I. Disperse Red 60 (colorant) | 1.2 parts |
| compound No. 83 | 2.0 parts |

A mixture having the above-described composition was subjected to a melt mixing treatment in a kneader at a temperature adjusted to 120°–130° C. and then spontaneously cooled for solidification. The solid was coarsely crushed by means of a coarse crusher, pulverized by means of a jet mill pulverizer and further classified by means of an air classifier to prepare a toner having a particle diameter of 5 to 20 μm.

100 parts of the toner thus prepared was mixed with 0.3 part of a colloidal silica in a Henschel mixer. The mixture was then mixed with an about 200-mesh iron powder carrier in a weight ratio of the toner to the iron powder carrier of 3:97 to prepare developer L. The developer L was then subjected to measurement of an initial specific electrification amount by means of a blow-off electrification amount measuring apparatus and found to be +27.5 μc/g. Further, the developer L was used for copying in a copying machine to give a clear red image having an excellent gradation without detriment to the hue inherent in the colorant.

Further, the developer L was subjected to the test for stability with time in the same manner as that of Example 46. The results are given in the following Table 16.

TABLE 16

| Test for change in the amount of electrification with time (unit: +μc/g) | | | | | | |
|---|---|---|---|---|---|---|
| Time (hr) | 0.25 | 0.5 | 1.0 | 2.0 | 4.0 | 6.0 |
| Developer L | 26.7 | 28.0 | 26.6 | 27.7 | 28.1 | 27.9 |

| Test for change in the amount of electrification under moist condition (unit: +μc/g) | | |
|---|---|---|
| Initial | After test | Change (%) |
| 26.7 | 25.4 | −4.9 |

As is apparent from the above-described results, the developer L had a very excellent stability after the lapse of time.

EXAMPLE 51

| | |
|---|---|
| styrene-butyl acrylate copolymer (binder) | 100 parts |
| low-molecular-weight polyethylene | 3 parts |
| Kayaset Yellow 963 (colorant) (a product of Nippon Kayaku Co., Ltd.) | 1.2 parts |
| compound No. 87 | 1.5 parts |

A mixture having the above-described composition was subjected to a melt mixing treatment (for 10 min) in a kneader at temperature adjusted to 125°–140° C. and then cooled for solidification. The solid was coarsely crushed by means of a coarse crusher, pulverized by means of a jet mill pulverizer and classified by means of an air classifier to prepare a toner having a particle diameter of 5 to 20 μm.

The toner thus prepared was mixed with an about 200-mesh iron powder carrier in a weight ratio of the toner to the iron powder carrier of 3:97 to prepare developer M. The developer M was then subjected to measurement of an initial specific electrification amount by means of a blow-off electrification amount measuring apparatus and found to be +33.1 μc/g. Further, the developer M was used for copying in a copying machine to give a clear yellow image having an excellent gradation without detriment to the hue inherent in the colorant.

Further, the developer M was subjected to the test for stability with time (a test for change in the amount of electrification with time and a test for change in the amount of electrification under a moist condition) in the same manner as described in Example 46. The results are given in the following Table 17.

TABLE 17

| Test for change in the amount of electrification with time (unit: +μc/g) | | | | | | |
|---|---|---|---|---|---|---|
| Time (hr) | 0.25 | 0.5 | 1.0 | 2.0 | 4.0 | 6.0 |
| Developer M | 42.5 | 43.9 | 44.8 | 43.7 | 46.5 | 45.8 |

| Test for change in the amount of electrification under moist condition (unit: +μc/g) | | |
|---|---|---|
| Initial | After test | Change (%) |
| 42.5 | 35.9 | −15.5 |

As is apparent from the above-described results, the developer M had a very excellent stability after the lapse of time.

EXAMPLE 52 to 77

Developers were prepared in the same manner as that of Example 46 through the use of compounds listed in the column of "Compound" and colorants listed in the column of "Colorant" of tables 18 to 21, and the formed toners were each subjected to measurement of an initial specific electrification amount and the a specific electrification amounts with time (referred to as "After test" in the following tables) in the same manner as that of Example 46.

As a result, it was found that the toners wherein use was made of any of the compounds exhibited less susceptibility to a change in the amount of electrification and the developers had a very excellent stability after the lapse of time. Copying was conducted by means of a copying machine to give a result wherein all of the developers provided a clear image having an excellent gradation and the hue inherent in the colorant.

TABLE 18

| Example No. | Compound No. | Colorant | Test for change in the amount of electrification with time (unit: +μC/g) Time (h) 0.25 | 0.5 | 1 | 2 | 4 | 6 |
|---|---|---|---|---|---|---|---|---|
| 52 | 71 | CI.Dis.Y.164 | 32.1 | 34.5 | 32.7 | 32.0 | 30.9 | 31.2 |
| 53 | 74 | " | 23.3 | 24.7 | 22.3 | 24.8 | 23.9 | 24.8 |
| 54 | 78 | CI.Pig.R.9 | 22.5 | 21.4 | 22.8 | 22.0 | 21.3 | 21.7 |
| 55 | 81 | " | 38.2 | 39.9 | 37.5 | 36.7 | 38.8 | 35.7 |

| Test for change in the amount of electrification under moist condition (unit: +μC/g) | | | | |
|---|---|---|---|---|
| Example No. | Compound No. | Initial | After test | Change (%) |
| 52 | 71 | 32.1 | 28.2 | −12.1 |
| 53 | 76 | 23.3 | 22.7 | −2.6 |
| 54 | 80 | 22.5 | 20.3 | −9.8 |
| 55 | 83 | 25.9 | 24.3 | −6.2 |
| 55 | 81 | 38.2 | 33.7 | −11.8 |

Colorant CI.: Color Index, Sol: Solvent
Dis: Disperse, Pig: Pigment, B: Blue, R: Red, Y: Yellow,

TABLE 19

| Example No. | Compound No. | Colorant | Test for change in the amount of electrification with time (unit: +μC/g) Time (h) 0.25 | 0.5 | 1 | 2 | 4 | 6 |
|---|---|---|---|---|---|---|---|---|
| 56 | 82 | CI.Pig.Y.1 | 25.3 | 24.9 | 24.7 | 25.3 | 25.5 | 23.2 |
| 57 | 86 | " | 22.1 | 23.5 | 21.7 | 21.5 | 23.7 | 21.0 |
| 58 | 93 | " | 30.1 | 28.7 | 29.9 | 30.9 | 28.4 | 28.3 |
| 59 | 95 | " | 24.7 | 23.4 | 24.9 | 24.0 | 23.1 | 23.7 |
| 60 | 96 | CI.Pig.R.146 | 41.2 | 43.8 | 42.7 | 43.6 | 44.5 | 45.6 |

Test for change in the amount of electrification under moist condition (unit: +μC/g)

| Example No. | Compound No. | Initial | After test | Change (%) |
|---|---|---|---|---|
| 56 | 82 | 25.3 | 25.1 | −0.8 |
| 57 | 86 | 22.1 | 20.0 | −9.5 |
| 58 | 93 | 30.1 | 26.5 | −12.0 |
| 59 | 95 | 24.7 | 23.5 | −4.9 |
| 60 | 96 | 41.2 | 36.3 | −11.9 |

TABLE 20

| Example No. | Compound No. | Colorant | Test for change in the amount of electrification with time (unit: +μC/g) Time (h) 0.25 | 0.5 | 1 | 2 | 4 | 6 |
|---|---|---|---|---|---|---|---|---|
| 61 | 102 | CARBON BLACK | 22.3 | 21.9 | 21.7 | 22.8 | 22.4 | 20.8 |
| 62 | 103 | CI.Pig.R.146 | 24.5 | 23.9 | 24.3 | 23.2 | 24.8 | 24.9 |
| 63 | 105 | " | 18.7 | 18.1 | 19.2 | 19.8 | 18.4 | 18.6 |
| 64 | 106 | CI.Sol.R.111 | 29.7 | 30.1 | 28.6 | 27.5 | 28.1 | 26.9 |
| 65 | 107 | " | 28.6 | 28.4 | 28.3 | 25.1 | 24.3 | 25.5 |
| 66 | 110 | CI.Dis.R.60 | 38.7 | 39.4 | 39.1 | 38.2 | 37.4 | 38.0 |

Test for change in the amount of electrification under moist condition (unit: +μC/g)

| Example No. | Compound No. | Initial | After test | Change (%) |
|---|---|---|---|---|
| 61 | 102 | 22.3 | 20.6 | −7.6 |
| 62 | 103 | 24.5 | 21.8 | −11.0 |
| 63 | 105 | 18.7 | 16.5 | −11.8 |
| 64 | 106 | 29.7 | 24.1 | −18.9 |
| 65 | 107 | 28.6 | 21.9 | −23.4 |
| 66 | 110 | 38.7 | 34.4 | −11.1 |

TABLE 21

| Example No. | Compound No. | Colorant | Test for change in the amount of electrification with time (unit: +μC/g) Time (h) 0.25 | 0.5 | 1 | 2 | 4 | 6 |
|---|---|---|---|---|---|---|---|---|
| 67 | 113 | CI.Dis.B.81 | 30.2 | 28.8 | 28.5 | 29.7 | 27.2 | 28.3 |
| 68 | 116 | " | 32.2 | 30.7 | 31.8 | 32.7 | 30.1 | 30.0 |
| 69 | 118 | CI.Dis.B.35 | 26.1 | 25.4 | 26.9 | 26.0 | 25.3 | 25.9 |
| 70 | 121 | CI.Dis.B.81 | 29.8 | 31.5 | 29.7 | 29.0 | 27.0 | 28.2 |
| 71 | 124 | " | 21.2 | 20.4 | 19.9 | 20.9 | 20.4 | 18.2 |
| 72 | 131 | CI.Dis.R.60 | 19.1 | 18.7 | 18.2 | 19.2 | 18.4 | 19.0 |

Test for change in the amount of electrification under moist condition (unit: +μC/g)

| Example No. | Compound No. | Initial | After test | Change (%) |
|---|---|---|---|---|
| 67 | 113 | 30.2 | 25.8 | −14.6 |
| 68 | 116 | 32.2 | 28.5 | −11.5 |
| 69 | 118 | 26.1 | 24.7 | −5.4 |
| 70 | 121 | 29.8 | 24.9 | −16.4 |
| 71 | 124 | 21.2 | 19.3 | −9.0 |
| 72 | 131 | 19.1 | 17.3 | −9.4 |

What is claimed is:

1. An electrophotographic toner containing a binder resin and at least one charge control agent represented by the following formula (1):

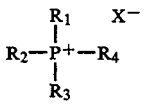

(1 wherein $R_1$, $R_2$ and $R_3$ independently represent an alkyl group having 4 to 8 carbon atoms, a cycloalkyl group, a substituted or unsubstituted aryl group, or a substituted or unsubstituted benzyl group; $R_4$ represents an alkenyl group, 3-phenyl-2-propenyl group, an alkynyl group, 3-phenyl-2-propynyl group, or a group represented by the formula:

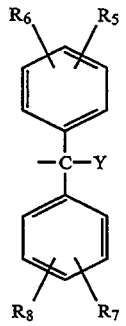

where $R_5$, $R_6$, $R_7$ and $R_8$ independently represent hydrogen atom, acetyl group, an alkyl group having 1 to 5 carbon atoms, methoxy group, ethoxy group, hydroxyl group, dimethylamino group, diethylamino group, or amino group, and Y represents hydrogen atom, an alkyl group having 1 to 8 carbon atoms, an aryl group having 6 to 8 carbon atoms, at aralkyl group having 7 to 10 carbon atoms, or a group of —CO—O—$R_9$ or —CO—NH—$R_9$ where $R_9$ represents a substituted or unsubstituted alkyl group, a substituted or unsubstituted aryl group, a substituted or unsubstituted aralkyl group, or a substituted or unsubstituted cycloalkyl group; and $X^-$ represents an anion.

2. An electrophotographic toner according to claim 1, wherein the compound represented by the formula (1) is a compound represented by the following formula (2):

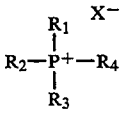

(2 wherein $R_1$, $R_2$ and $R_3$ independently represent an alkyl group having 4 to 8 carbon atoms, a cycloalkyl group, a substituted or unsubstituted aryl group, or a substituted or unsubstituted benzyl group; $R_4$ represents an alkenyl group, 3-phenyl-2-propenyl group, an alkynyl group, or 3-phenyl-2-propynyl group; and $X^+$ represents an anion.

3. An electrophotographic toner according to claim 1, wherein the compound represented by the formula (1) is a compound represented by the formula (3):

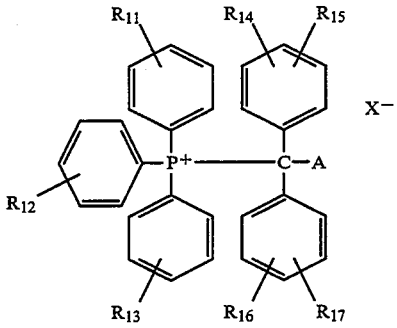

(3 wherein $R_{11}$, $R_{12}$ and $R_{13}$ independently represent hydrogen atom, an alkyl group having 1 to 6 carbon atoms, methoxy group, or ethoxy group; $R_{14}$, $R_{15}$, $R_{16}$ and $R_{17}$ independently represent hydrogen atom, acetyl group, an alkyl group having 1 to 5 carbon atoms, methoxy group, ethoxy group, hydroxyl group, dimethylamino group, diethylamino group, or amino group; A represents hydrogen atom, an alkyl group having 1 to 8 carbon atoms, an aryl group having 6 to 8 carbon atoms, an aralkyl group having 7 to 10 carbon atoms, or a group of —CO—O—$R_{18}$ or —CO—NH—$R_{18}$ where $R_{18}$ represents a substituted or unsubstituted alkyl group, a substituted or unsubstituted aryl group, a substituted or unsubstituted aralkyl group, or a substituted or unsubstituted cycloalkyl group; and $X^-$ represents an anion.

4. An electrophotographic toner according to claim 1, wherein the compound represented by the formula (1) is a compound represented by the following formula (4):

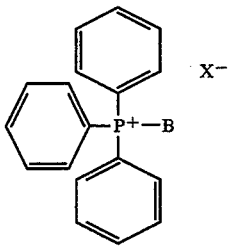

(4 wherein B represents an alkenyl group, 3-phenyl-2-propenyl group, an alkynyl group, or 3-phenyl-2-propynyl group, and $X^-$ represents an anion.

5. An electrophotographic toner according to claim 1, wherein the compound represented by the formula (1) is a compound represented by the following formula (5):

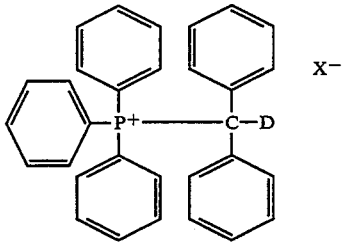

(5 wherein D represents hydrogen atom, an alkyl group having 1 to 8 carbon atoms, an aryl group having 6 to 8 carbon atoms, an aralkyl group having 7 to 10 carbon atoms, or a group of —CO—O—$R_{19}$ or —CO—N-H—$R_{19}$ where $R_{19}$ represents a substituted or unsubstituted alkyl group, a substituted or unsubstituted aryl group, a substituted or unsubstituted aralkyl group, or a substituted or unsubstituted cycloalkyl group, and $X^-$ represents an anion.

6. An electrophotographic toner according to claim 1, wherein toner particles comprise said binder resin, a colorant and the charge control agent represented by the formula (1) in respective amounts effective for electrophotography.

7. An electrophotographic toner according to claim 1, wherein $R_1$, $R_2$ and $R_3$ independently represent cyclohexyl group, or a substituted or unsubstituted aryl group having 6 to 8 carbon atoms.

8. An electrophotographic toner according to claim 1, wherein $R_4$ represents a substituted or unsubstituted alkenyl group having 3 to 6 carbon atoms, or a substituted or unsubstituted alkynyl group having 3 to 6 carbon atoms.

9. An electrophotographic toner according to claim 1, wherein $R_9$ represents a substituted or unsubstituted alkyl group having 1 to 12 carbon atoms, a substituted or unsubstituted cycloalkyl group having 3 to 6 carbon atoms, a substituted or unsubstituted aryl group having 6 to 8 carbon atoms, or a substituted or unsubstituted aralkyl group having 7 to 10 carbon atoms.

10. An electrophotographic toner according to claim 1, wherein Y represents a substituted or unsubstituted aryl group selected from the group consisting of phenyl and naphthyl, and a substituted or unsubstituted aralkyl group selected from the group consisting of benzyl, α-methylbenzyl, diphenylmethyl and phenethyl.

11. An electrophotographic toner according to claim 1, wherein $X^-$ represents an electrophotographically acceptable anion.

* * * * *